US012337436B2

(12) United States Patent
Beaudet et al.

(10) Patent No.: US 12,337,436 B2
(45) Date of Patent: Jun. 24, 2025

(54) SKATE BLADE SHARPENING SYSTEM

(71) Applicant: Velasa Sports, Inc., Acton, MA (US)

(72) Inventors: Daniel A. Beaudet, Lexington, MA (US); Ivan D. Goryachev, Nashua, NH (US); Brian Austin, Boston, MA (US); Russell K. Layton, Jr., Acton, MA (US)

(73) Assignee: Velasa Sports, Inc., Acton, MA (US)

( * ) Notice: Subject to any disclaimer, the term of this patent is extended or adjusted under 35 U.S.C. 154(b) by 0 days.

(21) Appl. No.: 18/649,552

(22) Filed: Apr. 29, 2024

(65) Prior Publication Data

US 2025/0025975 A1 Jan. 23, 2025

Related U.S. Application Data

(63) Continuation of application No. 16/989,770, filed on Aug. 10, 2020, now Pat. No. 11,969,851.
(Continued)

(51) Int. Cl.
*B24B 3/00* (2006.01)
*A63C 3/10* (2006.01)
(Continued)

(52) U.S. Cl.
CPC ..... *B24B 3/003* (2013.01); *A63C 3/10* (2013.01); *B24B 9/04* (2013.01); *B24B 55/102* (2013.01)

(58) Field of Classification Search
CPC ..... B24B 3/003; B24B 9/04; B24B 41/02; B24B 45/00; B24B 45/003; B24B 55/04;
(Continued)

(56) References Cited

U.S. PATENT DOCUMENTS 1,219,004 A 3/1917 Kalanquin
1,381,724 A * 6/1921 Maloney ..... A45D 27/22 30/47
(Continued)

FOREIGN PATENT DOCUMENTS

CA 1118514 2/1982
CA 1229985 12/1987
(Continued)

OTHER PUBLICATIONS

Invitation to Pay Additional Fees issued in International Application No. PCT/US2015/057078, mailed on Feb. 24, 2016.
(Continued)

*Primary Examiner* — Joel D Crandall
(74) *Attorney, Agent, or Firm* — KNOBBE, MARTENS, OLSON & BEAR, LLP

(57) ABSTRACT

The present disclosure provides for a skate sharpening system comprising an operative unit and a base, the operative unit comprising a central body, the central body comprising a skate receiving slot, a skate clamp being positioned adjacent to the skate receiving slot such that a skate can be secured within the skate receiving slot for a sharpening operation, the operative unit further comprising a grinding unit, the grinding unit being configured to translate along a length of the slot such that the grinding unit can conduct the sharpening operation on the skate that is secured within the skate receiving slot, the operative unit being positioned over at least a portion of the base, the base comprising a swarf-receiving cavity, the operative unit and the base being pivotably connected.

20 Claims, 21 Drawing Sheets

Related U.S. Application Data

(60) Provisional application No. 63/059,885, filed on Jul. 31, 2020.

(51) Int. Cl.
*B24B 9/04* (2006.01)
*B24B 55/10* (2006.01)

(58) Field of Classification Search
CPC ..... B24B 55/052; B24B 55/06; B24B 55/102; A63C 3/10
USPC ..... 451/45, 179, 182, 185, 192, 193, 198, 451/202, 203, 205, 206, 234, 371, 383, 451/451, 453, 456
See application file for complete search history.

(56) References Cited

U.S. PATENT DOCUMENTS 2,114,967 A 4/1938 Myers
2,438,543 A 3/1948 Custin et al.
2,563,018 A 8/1951 Fello
2,599,952 A 6/1952 Strayer
2,722,792 A 11/1955 Harrington
2,775,075 A 12/1956 McMaster et al.
2,819,568 A 1/1958 Kasick
2,990,661 A 7/1961 Hackett
3,118,256 A 1/1964 Witt
3,259,959 A 7/1966 Tobey
3,524,285 A 8/1970 Rutt
3,574,975 A 4/1971 Liss
3,650,073 A 3/1972 Weisman
3,735,533 A 5/1973 Salberg
3,742,655 A 7/1973 Oliver
3,756,796 A 9/1973 Miller
3,789,551 A 2/1974 Norris et al.
3,800,632 A 4/1974 Juranitch
3,827,185 A 8/1974 Smith
3,839,828 A 10/1974 Arnold
3,881,280 A * 5/1975 Thompson ..... B24B 3/003 451/241
3,948,001 A 4/1976 Miyazawa et al.
3,956,857 A 5/1976 Weisman
3,988,124 A 10/1976 Babcock
3,988,865 A 11/1976 Weisman
4,055,026 A 10/1977 Zwicker
4,078,337 A 3/1978 Chiasson et al.
4,094,101 A 6/1978 Robinson
4,109,419 A 8/1978 Broadbent
4,172,343 A 10/1979 Sakcriska
4,235,050 A * 11/1980 Hannaford ..... B24B 3/003 451/151
4,235,052 A 11/1980 Guidry
4,271,635 A 6/1981 Szalay
4,294,043 A 10/1981 Sakcriska
4,516,357 A 5/1985 Gach
4,534,134 A 8/1985 Consay et al.
4,549,372 A 10/1985 Sexton et al.
4,558,541 A 12/1985 Consay
4,570,387 A 2/1986 Unno et al.
4,615,144 A 10/1986 Peacock et al.
4,615,149 A 10/1986 Yoneda et al.
4,722,152 A 2/1988 Ek et al.
4,756,125 A 7/1988 Kadnar
4,967,515 A 11/1990 Tsujiuchi et al.
5,009,039 A 4/1991 Lager et al.
D328,305 S 7/1992 Wong
5,127,194 A 7/1992 Jobin
5,129,190 A 7/1992 Kovach et al.
5,139,138 A * 8/1992 Isaksen ..... B26B 21/06 451/442
5,172,680 A * 12/1992 Swan ..... B23Q 11/0042 83/100
5,177,901 A 1/1993 Smith
5,189,845 A 3/1993 Courchesne
5,259,148 A 11/1993 Wiand
5,547,416 A 8/1996 Timms
5,562,526 A 10/1996 Yoneda et al.
5,591,069 A * 1/1997 Wurthman ..... B24D 15/066 451/193
5,601,473 A 2/1997 Strain et al.
5,823,854 A 10/1998 Chen
5,897,428 A 4/1999 Sakcriska
5,924,915 A 7/1999 Wachtler
5,989,114 A 11/1999 Donahue et al.
6,116,989 A 9/2000 Balastik
6,422,934 B1 7/2002 Blach et al.
D478,905 S 8/2003 Byrne et al.
6,602,109 B1 8/2003 Malkin et al.
6,626,745 B1 9/2003 Bernard
7,018,280 B2 3/2006 Walker
D525,936 S 8/2006 Tanabe et al.
D527,225 S 8/2006 Krieger et al.
7,104,876 B1 9/2006 Lin
7,118,466 B2 10/2006 Laney
7,121,932 B2 10/2006 Liao
7,220,161 B2 5/2007 Eriksson
7,387,562 B1 6/2008 Blum
7,473,164 B2 1/2009 Sunnen
D594,952 S 6/2009 Orihara et al.
D595,318 S 6/2009 Cigarini
D603,432 S 11/2009 Wilson et al.
7,934,978 B2 5/2011 Wilson et al.
8,197,304 B2 6/2012 Hummel
D665,830 S 8/2012 Wilson et al.
8,246,425 B2 8/2012 Schudel
8,277,284 B2 10/2012 Wilson et al.
8,316,742 B2 11/2012 Craig et al.
D681,077 S 4/2013 Wilson et al.
8,430,723 B2 4/2013 Moon
D682,646 S 5/2013 Knopp et al.
8,696,407 B2 4/2014 Dovel
D708,922 S 7/2014 Evans
8,801,501 B2 * 8/2014 Worthington ..... B26B 21/40 451/163
8,827,768 B2 9/2014 Allen
8,888,567 B2 11/2014 Allen et al.
D725,453 S 3/2015 Lodato et al.
9,114,498 B1 8/2015 Layton, Jr. et al.
9,242,330 B1 * 1/2016 Layton, Jr. ..... B24B 3/003
D757,514 S 5/2016 Cigarini
9,339,911 B2 5/2016 Eriksson
9,352,437 B2 * 5/2016 Layton, Jr. ..... B24B 3/003
9,352,444 B2 5/2016 Layton, Jr. et al.
9,475,175 B2 * 10/2016 Layton, Jr. ..... B24B 3/003
D772,670 S 11/2016 Barezzani et al.
9,566,682 B2 * 2/2017 Layton, Jr. ..... B24B 3/003
9,573,236 B2 * 2/2017 Layton, Jr. ..... G01B 5/255
9,669,508 B2 * 6/2017 Layton, Jr. ..... B24B 17/10
D793,830 S 8/2017 Layton, Jr. et al.
9,902,035 B2 * 2/2018 Layton, Jr. ..... B24D 5/16
10,065,282 B2 9/2018 Layton, Jr. et al.
10,300,574 B2 5/2019 Layton, Jr. et al.
10,335,925 B2 7/2019 Layton, Jr. et al.
11,919,119 B2 3/2024 Layton, Jr. et al.
2002/0009964 A1 1/2002 Wolf et al.
2003/0156401 A1 8/2003 Komine et al.
2004/0209547 A1 10/2004 Hatano et al.
2005/0130571 A1 6/2005 Sunnen
2006/0040587 A1 2/2006 Eriksson
2006/0159533 A1 7/2006 Zeiler et al.
2006/0183411 A1 * 8/2006 Moon ..... B24B 3/003 451/182
2006/0223419 A1 10/2006 Moon
2007/0054598 A1 3/2007 Uchida et al.
2007/0184756 A1 8/2007 Dieck et al.
2007/0251677 A1 * 11/2007 Hwang ..... H01L 23/467 257/722
2008/0004743 A1 1/2008 Goers et al.
2008/0176496 A1 7/2008 Tasi
2008/0280548 A1 11/2008 Wilson et al.
2010/0068975 A1 * 3/2010 Yadid ..... B24D 15/10 451/224
2010/0125362 A1 5/2010 Canora et al.

(56) References Cited

U.S. PATENT DOCUMENTS

| | | | | |
|---|---|---|---|---|
| 2011/0169233 | A1 | 7/2011 | Wilson et al. | |
| 2011/0201257 | A1 | 8/2011 | Walker | |
| 2012/0108151 | A1 | 5/2012 | Swist | |
| 2012/0190279 | A1 | 7/2012 | Ficai | |
| 2012/0302147 | A1 | 11/2012 | Trautner et al. | |
| 2013/0344774 | A1 | 12/2013 | Allen | |
| 2014/0087639 | A1* | 3/2014 | Worthington | B26B 21/50 451/367 |
| 2014/0179201 | A1 | 6/2014 | Proulx | |
| 2014/0213160 | A1 | 7/2014 | Page | |
| 2015/0061204 | A1 | 3/2015 | Talbot | |
| 2015/0140901 | A1 | 5/2015 | Eriksson | |
| 2015/0367224 | A1 | 12/2015 | Schatz | |
| 2016/0114454 | A1* | 4/2016 | Layton, Jr. | B24D 5/10 451/5 |
| 2017/0165808 | A1* | 6/2017 | Buser | B24B 55/102 |
| 2017/0355056 | A1* | 12/2017 | Layton, Jr. | B24B 3/003 |
| 2018/0126250 | A1* | 5/2018 | Proulx | B24B 41/06 |
| 2020/0016716 | A1* | 1/2020 | Layton, Jr. | B24B 41/06 |
| 2020/0376621 | A1 | 12/2020 | Dovel | |
| 2021/0069853 | A1 | 3/2021 | Berglund | |

FOREIGN PATENT DOCUMENTS

| | | | |
|---|---|---|---|
| CA | 2260531 | | 8/1999 |
| CA | 2309222 | | 11/2000 |
| CA | 2323321 | | 4/2002 |
| EP | 0175168 | A2 | 3/1986 |
| EP | 1604782 | A1 | 12/2005 |
| WO | WO 2009/076496 | A2 | 6/2009 |
| WO | WO 2016/065237 | A2 | 4/2016 |
| WO | WO 2016/183663 | A1 | 11/2016 |

OTHER PUBLICATIONS

International Search Report & Written Opinion of the International Searching Authority issued in International Application No. PCT/US2015/057078, mailed on May 2, 2016.

International Preliminary Report on Patentability and Written Opinion of the International Searching Authority issued in International Application No. PCT/US2015/057078, mailed on May 4, 2017.

Extended European Search Report issued in European Patent Application No., 21170266.7, on Oct. 22, 2021, in 10 pages.

Brinksmeier et al., "Sensible Schleifwerkzeuge, Wie werkzeugseitige Piezosensorik bei der Werkzeug-und Prozessueberwachung hilft," Werkstatt Uno Betrieb, Hanser, Munchen, vol. 133(4), Apr. 1, 2000, XP000954470, ISSN: 0043-2792.

"Cag One Service AB", downloaded from www.cagone.pl/dokumenty/cag-one-users-manual.pdf, 32 pages, Sep. 2009.

"Prosharp AS2001 Allpro, AS1001 Portable, Skatepal PRO3 Instructions", downloaded from www.prosharp.net/file/broschyroriginalinstructions-eng.pdf, 40 pages, Apr. 2013.

"Skatepal Pro Instructions", downloaded from www.prosharp.net/file/instruction-skatepal-pro2-eng.pdf, 12 pages, Oct. 2010.

"Spareparts Skatepal Pro 3", downloaded from www.prosharp.net/file/schematicssp13a1.pdf, 6 pages, Mar. 2013.

"SSM Catalog", downloaded from www.skyice.org/ssm_catalogue_2011.pdf, 12 pages.

Cag One Skate Sharpeners, "Cag One New Evolution Sharpening Machine", URL: http://cagone.com/evolution/, pp. 1-4.

Craig Forsythe, "Cag Speed III Sharpener Manual", Teflone Publications MMV, downloaded from www.cagone.com/img/speed.pdf, 14 pages, Aug. 2009.

Prosharp, "Grinding Wheels—SkatePals", 2015 ProSharp AB, URL: http://prosharp.com/products/grinding-wheels/grinding-wheels, pp. 1-9.

International Search Report & Written Opinion of the International Searching Authority issued in International Application No. PCT/US2021/070805, mailed on Jul. 31, 2020.

* cited by examiner

SKATE BLADE SHARPENING SYSTEM

INCORPORATION BY REFERENCE TO ANY PRIORITY APPLICATION

Any and all applications for which a foreign or domestic priority claim is identified in the Application Data Sheet as filed with the present application are incorporated by reference under 37 CFR 1.57 and made a part of this specification.

BACKGROUND OF THE INVENTION

Field

The present disclosure generally relates to machines configured to sharpen blades for ice skates. More particularly, the present disclosure relates to such machines configured for automated sharpening of blades for ice skates.

Description of the Related Art

Ice skates engage the surface of the ice on a pair of edges. Over time, the edges can become dull or nicked and, in such conditions, the performance of the ice skates is less than optimal. To restore the performance of the ice skates, the skate blades can be sharpened.

While the frequency of ice skate blade sharpening differs depending upon the individual, the recommended frequency for most serious skaters is one sharpening for every three to five hours of ice time. When it is time for the sharpening, few people have the equipment necessary to sharpen the skates and, for that reason, the skates need to be dropped off at a local skate shop or ice rink for sharpening. The frequent trips for sharpening can become an annoyance and many skaters will skate on less than optimal skate blades simply to avoid the extra trips or time in line at the skate shop or rink. Even if people had access to the equipment, few people have the training or skills necessary to sharpen their own skates.

SUMMARY

A need exists for skate sharpening machines that are simple to use and cost effective enough for home use. Certain features, aspects and advantages of the present invention address a myriad of challenges encountered when designing a portable skate sharpening machine that is cost effective and easy to use. The systems, methods and devices described herein have innovative aspects, no single one of which is indispensable or solely responsible for their desirable attributes. Without limiting the scope of the claims, some of the advantageous features will now be summarized.

In accordance with certain features, aspects and advantages of at least one of the embodiments disclosed herein, a skate sharpening system includes an operative unit and a base, the operative unit comprising a central body, the central body comprising a skate receiving slot, a skate clamp being positioned adjacent to the skate receiving slot such that a skate can be secured within the skate receiving slot for a sharpening operation, the operative unit further comprising a grinding unit, the grinding unit being configured to translate along a length of the slot such that the grinding unit can conduct the sharpening operation on the skate that is secured within the skate receiving slot, the operative unit being positioned over at least a portion of the base, the base comprising a swarf-receiving cavity, the operative unit and the base being pivotably connected.

In some embodiments, the base comprises a first side wall and a second side wall, the operative unit being pivotably connected to the first and second side walls.

In some embodiments, the base comprises a bucket.

In some embodiments, the bucket has a height, a width and a depth, the width being greater than the height and the depth.

In some embodiments, the bucket comprises a bottom surface, the bottom surface being supported by a plurality of feet and the bottom surface comprising a reflective region.

In some embodiments, a biasing assembly interacts between the operative unit and the base to resist closure of the operative unit relative to the base.

In some embodiments, the first side wall comprises a first mount and the second side wall comprises a second mount, the operative unit being connected to the first mount and the second mount.

In some embodiments, each of the first mount and the second mount is defined by a saddle shape.

In some embodiments, the operative unit comprises a first biasing assembly that is received within the first mount and a second biasing assembly that is received within the second mount.

In some embodiments, the first and second biasing assemblies each comprises a torsion spring that opposes pivotal movement of the operative unit toward a closed position against the base.

In some embodiments, the biasing assemblies and the mounts comprise a protuberance that is received within a pocket, the protuberances and the pockets cooperating to resist pivoting movement of the first and second biasing assemblies relative to the first and second mounts.

In some embodiments, the system includes a position lock that secures the operative unit against movement relative to the base.

In some embodiments, the position lock comprises at least a first rod that translates relative to the operative unit.

In some embodiments, the first rod engages with at least one corresponding recess.

In some embodiments, the operative unit is locked against pivotal movement relative to the base when the first rod is engaged with at least one corresponding recess.

In some embodiments, the system includes a first actuator that is operatively connected to the first rod.

In some embodiments, the base is a molded resin-based component.

In some embodiments, the resin-based component is optically translucent, optically transparent, or optically clear.

In accordance with certain features, aspects and advantages of at least another one of the embodiments disclosed herein, a skate blade sharpening system includes a clamp configured to retain a skate blade in a sharpening position, a centerline of the sharpening position having a first predetermined location; a motor-driven rotating shaft, the shaft having a wheel-mounting location at which a grinding wheel is mounted to rotate with the shaft and contact the skate blade in the sharpening position during a sharpening operation; and an adjustment mechanism comprising: an alignment shaft; a bushing positioned on a longitudinal portion of the alignment shaft; a compression mechanism applying pressure to the bushing, wherein the pressure is applied to the alignment shaft, wherein the pressure is configured to substantially eliminate unintentional rotational movement of the alignment shaft; and an adjustment member configured to rotate the alignment shaft, wherein rotation of the alignment shaft is configured to vary a position of the grinding wheel relative to the centerline of the sharpening position.

In some embodiments, the bushing is a threaded bushing and the threaded bushing is threaded onto a threaded portion of the alignment shaft or the bushing is a through hole bushing positioned on an unthreaded portion of the alignment shaft.

In some embodiments, the bushing is a threaded bushing threaded onto a threaded portion of the alignment shaft and the adjustment mechanism further comprises a through hole bushing, and wherein the alignment shaft comprises an unthreaded portion, wherein the through hole bushing is positioned on the unthreaded portion of the alignment shaft.

In some embodiments, the through hole bushing is reamed and has an interference fit with the unthreaded portion of the alignment shaft.

In some embodiments, the alignment shaft comprises a detent portion having a plurality of detents circumferentially disposed about a circumference of the alignment shaft, wherein the adjustment mechanism further comprises a spring pin configured to ride within a detent.

In some embodiments, manipulation of the adjustment member is configured to move the alignment shaft relative to the spring pin such that the movement of each detent past the spring pin results in at least one of an auditory or tactile indication of movement and a defined amount of linear movement of the grinding wheel.

In some embodiments, the defined amount of linear movement is between 0.005 and 0.04 of a mm per detent.

In some embodiments, the bushing is formed from a polymer.

In some embodiments, the adjustment member is adjustable by a user, wherein a diameter of adjustment member is greater than a diameter of the alignment shaft.

In some embodiments, the system includes a controller configured to control a motor, wherein the adjustment member is adjustable by the motor.

In some embodiments, the threaded bushing includes tabs extending radially from a body of the bushing to prevent rotation of the threaded bushing during rotation of the alignment shaft.

In some embodiments, the pressure on the bushing is sufficient to substantially prevent hysteresis based on movement of the alignment shaft not caused by intentional movement of the adjustment member.

In accordance with certain features, aspects and advantages of at least another one of the embodiments disclosed herein, a skate blade sharpening system includes a blade retention mechanism configured to securely hold a blade to be sharpened in a sharpening operation within a skate blade opening of the skate blade sharpening system; a rotating shaft driven by a grinding motor and configured to have a grinding wheel mounted thereon, the grinding wheel contacting the blade during the sharpening operation; an arbor on the rotating shaft, the arbor having a heat-conducting mating with the grinding wheel when the grinding wheel is mounted on the rotating shaft, and heat dissipation features extending a portion of the width of the arbor; and an arbor shroud preventing access to the heat dissipation features through the skate blade opening of the skate blade sharpening system.

In some embodiments, the arbor shroud covers at least the portion of the width of the heat dissipation features.

In some embodiments, the arbor shroud further comprises a sidewall that forms an opening in the arbor shroud, wherein the arbor is disposed at least partially within the opening, the opening extending about at least a circumferential portion of the arbor, wherein the arbor shroud is fixed in a stationary position relative to the rotation of the rotating shaft, wherein a gap is formed between the sidewall and the arbor such that the arbor does not contact the sidewall when rotating.

In some embodiments, the arbor shroud has an opening on its circumference configured to direct airflow.

In some embodiments, the opening is up to one half the circumference of the arbor.

In some embodiments, a carriage moves with grinding wheel during the sharpening operation.

In some embodiments, the arbor shroud is coupled to the spindle assembly.

In some embodiments, the arbor shroud includes at least one retention feature.

In some embodiments, arbor shroud is coupled to the spindle assembly by at least one fastener.

In some embodiments, the arbor shroud includes a plurality of openings in a back wall of the shroud configured to direct airflow.

In some embodiments, the arbor shroud includes at least one vertical displacement member on at least one side of the shroud that is configured to vertically displace the grinding wheel relative to the skate blade opening.

In some embodiments, the vertical displacement members extend distally from shroud.

In some embodiments, the at least one vertical displacement member is configured to prevent the grinding wheel from contacting jaws of a skate blade retentions system during a sharpening operation.

In some embodiments, the heat dissipation features are a set of vanes.

In some embodiments, the arbor shroud moves transversely along the skate blade with the arbor during the sharpening operation.

BRIEF DESCRIPTION OF THE DRAWINGS

Throughout the drawings, reference numbers can be reused to indicate general correspondence between reference elements. The drawings are provided to illustrate example embodiments described herein and are not intended to limit the scope of the disclosure.

DETAILED DESCRIPTION OF SOME EMBODIMENTS

Figure 1:
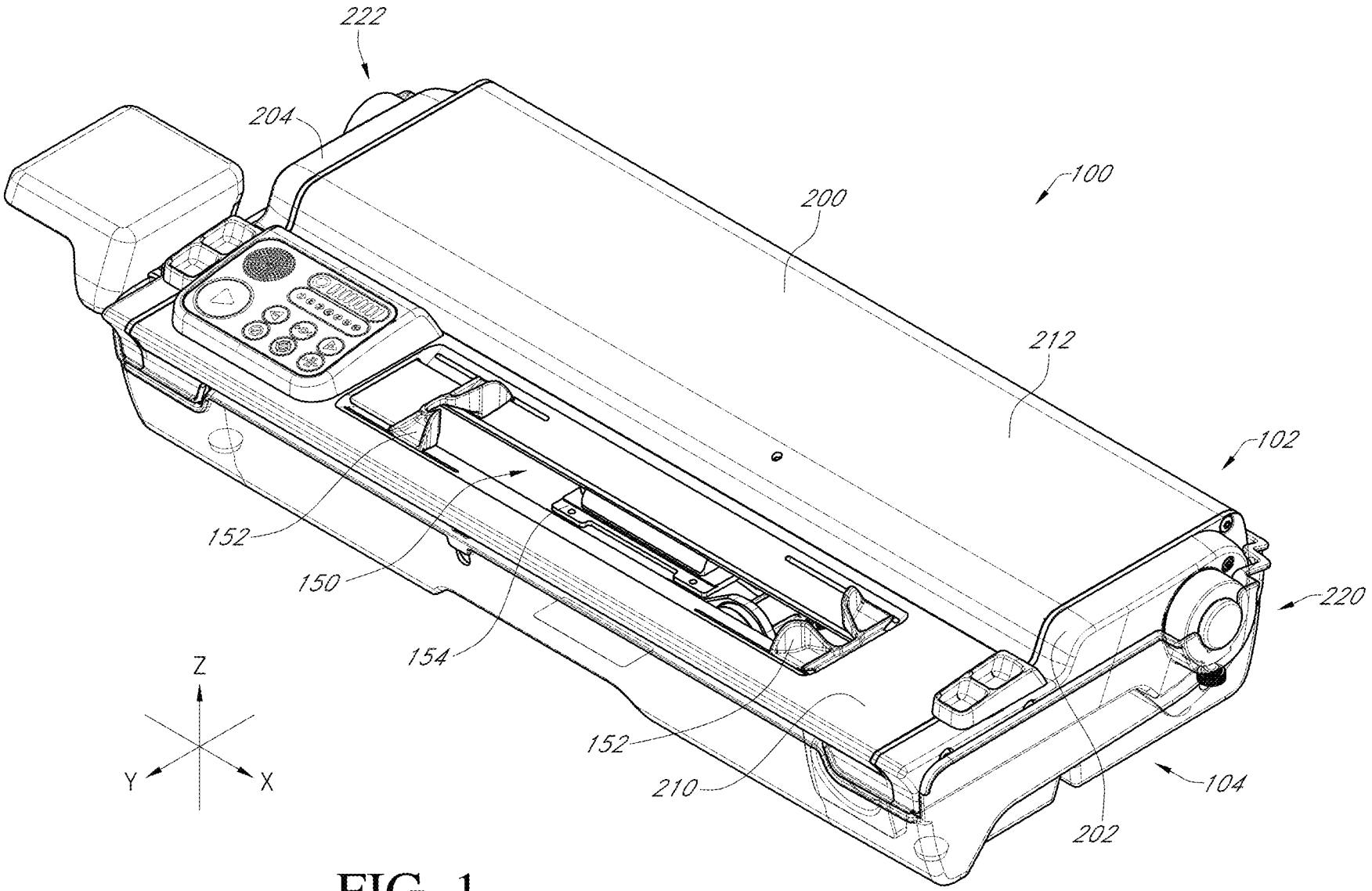
FIG. 1 is a perspective view of a skate sharpening system that is arranged and configured in accordance with certain features, aspects and advantages of the present disclosure.

FIG. 1 is a perspective view of a skate sharpening system 100 used to sharpen the blades of ice skates. As illustrated, the skate sharpening system 100 is designed and configured to provide a safe, clean, and automated skate sharpening system. The skate sharpening system 100 allows users to sharpen skates at home, on their own schedule, and with professional quality results. Operation of the skate sharpening system 100 generally can be as described in U.S. patent application Ser. No. 16/424,294, which was filed on May 28, 2019 and which published as U.S. Publ. No. 2020/0016716A1 on Jan. 16, 2020, which is hereby incorporated by reference. The following disclosure will touch upon certain improvements to the system disclosed in that published application.

FIG. 1 also shows a coordinate system for references to spatial directions within this disclosure. The X direction is left-to-right, the Y direction back-to-front, and the Z direction bottom-to-top with respect to the skate sharpener 10 in the upright, front-facing orientation of FIG. 1. This coordinate system also defines an X-Y plane (horizontal), X-Z plane (vertical and left-to-right), and Y-Z plane (vertical and front-to-back).

The illustrated skate sharpening system 100 comprises an operative unit 102 and a base 104. As will be described below, the illustrated operative unit 102 contains blade retention assemblies for gripping an ice skate blade, grinding assemblies for sharpening the skate blade, and control arrangements for controlling the skate sharpener 100. An ice skate blade can by inserted into the skate slot 150 and secured by blade retention jaws 154. Slot covers 152 overly at least a portion of the skate slot 150. The slot covers 152 can be moved along a portion of the length of the slot 150 to abut the ends of the skate blades that are secured by the blade retention jaws 154.

The base 104 supports the operative unit 102 during operation. In the illustrated configuration, the base 104 provides a receptacle for capturing the swarf and collecting the dust resulting from a sharpening operation. In some configurations, the operative unit 102 can be removed from the base 104. In the illustrated configuration, the operative unit 102 is configured to pivot open relative to the base 104 and the operative unit 102 is configured to be completely removed from the base 104 as desired.

The Base

The base 104 can have any suitable configuration and can be formed of any suitable material. In the illustrated configuration, the base 104 is molded of a resin-based material. In some such configurations, the base 104 is formed from an optically translucent or an optically transparent material. To improve monitoring of operation of the skate sharpening system 100, the base 104 can be formed from an optically clear material. Some desired materials from which the base 104 can be formed include, but are not limited to, polycarbonate, polystyrene, PET, or PETG.

In some embodiments, the base 104 can comprise a plastic or metal structure and a clear or translucent window. The window can be positioned along any portion of the base. In some configurations, the window can be positioned on the front of the base such that the base 104 can provide structure and rigidity while maintaining a portion for viewing operation of the skate sharpening system.

Figure 10:
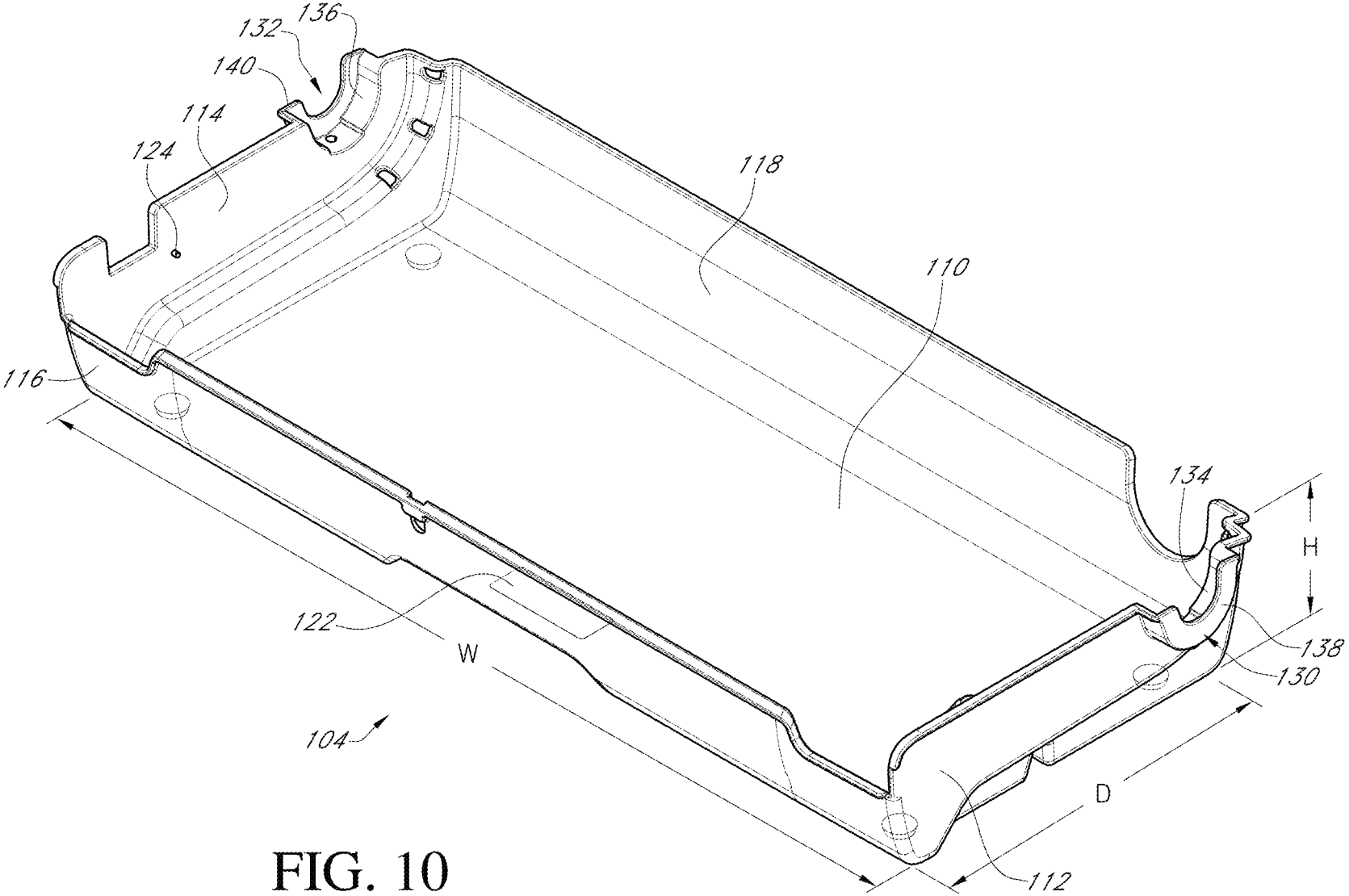
FIG. 10 is a perspective view of a base of the skate sharpening system of FIG. 1.

With reference to FIG. 10, the base 104 can be configured as a shallow bucket. As used herein, the term "bucket" is intended to mean an open container or a container with an opening. The bucket forms a shallow enclosure or a shallow tray in the illustrated configuration. The bucket can have one or more side wall and a bottom wall. The illustrated base 104 is defined by a bucket that comprises a bottom wall 110 and four side walls. The bottom wall 110 can be bounded by a right side wall 112, a left side wall 114, a front wall 116, and a rear wall 118.

Figure 7:
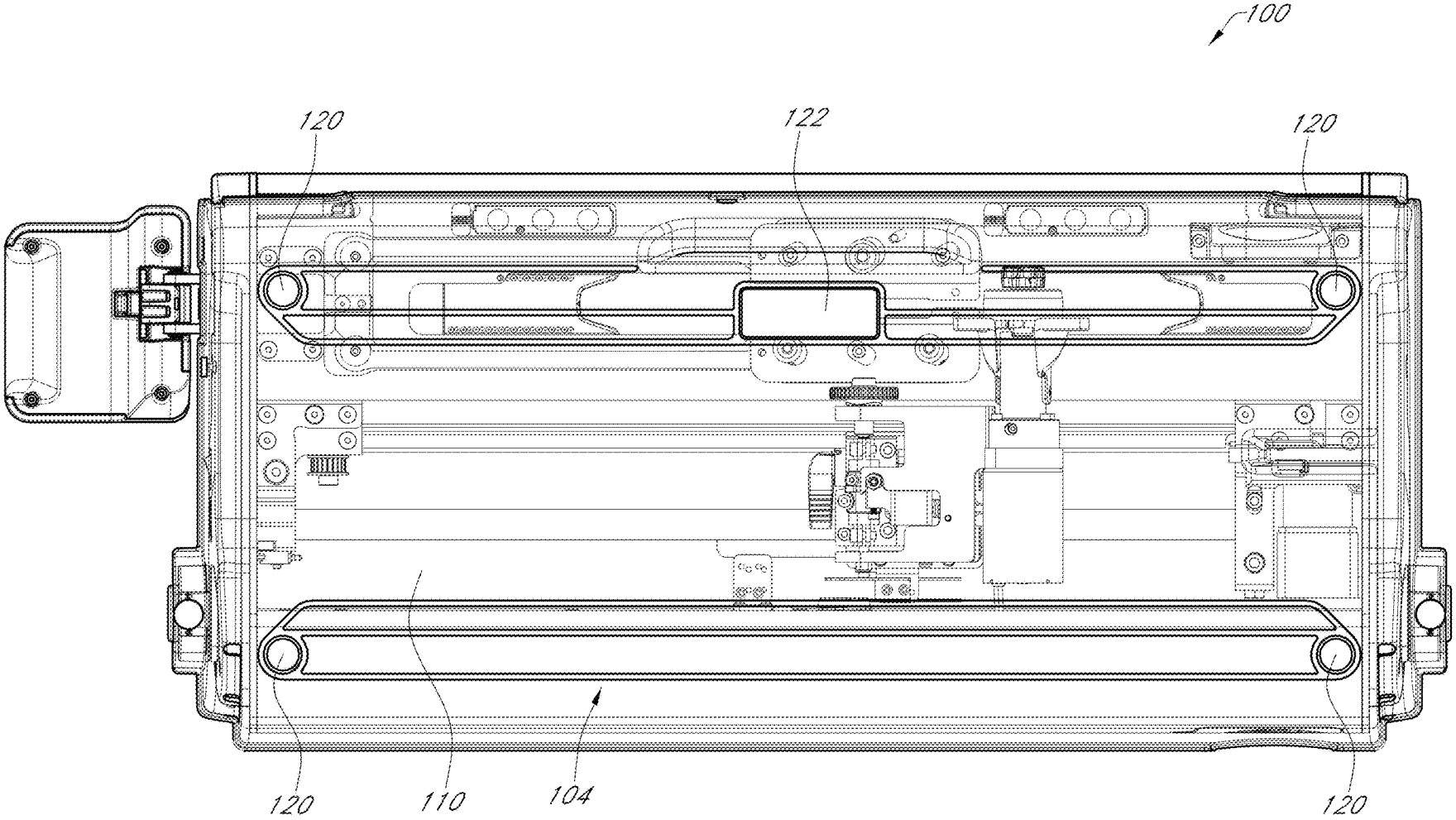
FIG. 7 is a bottom view of the skate sharpening system of FIG. 1.

With reference to FIG. 7, the bottom wall 110 can include feet 120. In the illustrated configuration, the bottom wall 110 includes four feet 120. While the feet 120 can be adjustable in some configurations to provide a small degree of leveling, the illustrated feet 120 are non-adjustable rubber feet. The non-adjustable rubber feet 120 can be adhered within features that are integrally molded into the base 104. The features are integrally molded into the bottom wall 110 in the illustrated configuration. In some embodiments, the feet are protuberances that are integrally molded into the bottom wall 110. Given the material of the base 104, the base 104 is capable of flexing sufficiently to accommodate minor irregularities in any surface upon which the base is placed. For example, it has been found that the base 104 is capable of flexing a sufficient degree to accommodate an offset between any two feet 120 of up to 6 mm over a span of 19 cm.

The illustrated base 104 has a height H, a width W, and a depth D. The width W exceeds the depth D and the height H. The width W is large enough to underlie an adult or senior skate supported in the operative unit 102 for a sharpening operation. The height H is less than the depth D. In some configurations, the height H is just large enough to accommodate moving components of the operative unit 102. In some such configurations, the height H is just enough to provide access to a grinding wheel 340 of the operative unit 102 and a filter assembly of the operative unit 102. In one configuration, the height is 103 mm, the depth is 288 mm, and the width is 630 mm. Given that the skate sharpening system 100 can be used in a home, the base 104 is configured to have a footprint of less than 2000 $cm^2$. In some configurations, the width is about twice the depth. In some configurations, the footprint is less than 2000 $cm^2$ with a width that is about twice the depth. Such a small footprint and configuration is difficult to achieve while accommodating senior skates and the movement of sharpening components of the operative unit 102 while providing a skate sharpening system that can sit on a countertop.

With reference to FIG. 7, in the illustrated configuration, a reflective surface 122 can be provided on at least a portion of the bottom wall 110 of the base 104. The reflective surface 122 can be positioned under a path of the moving components of the operative unit 102. In particular, the reflective surface 122 can be positioned such that the reflective surface 122 can aid during an alignment process. In some configurations, the reflective surface is provided by a reflective sticker that is secured in position using adhesive. Other configurations can be used keeping in mind a desire to have the reflective surface properly positioned after cleaning of the base 104 following a series of sharpening operations. In other words, the reflective surface desirably does not become dislodged as a result of routine operation of the device, including cleaning of the base 104.

At least one of the right side wall 112 and/or the left sidewall 114 can carry a magnet 124. As described above, the operative unit 102 and the base 104 can be connected such that the operative unit 102 pivots relative to the base 104. In one configuration, the magnet 124 aligns with a sensor such that operation of the sharpening assembly of the operative unit 102 can be prevented unless the operative unit 102 is closed against the base 104. The position of the operative unit 102 relative to the base 104 can be indicated by the sensor depending upon the placement of the sensor relative to the magnet 124. In some configurations, the magnet 124 cooperates with a reed switch that tells the operative unit 102 whether the operative unit 102 is in an open position or a closed position. Other configurations may include the use of different switches or sensors to determine the position of the operative unit 102 relative to the base 104. For example, position detection can be performed by sensing means that include one or more of an optical switch, a mechanical switch, angle sensors, accelerometers, or other types of switches and sensors.

The front wall 116 can comprise at least one cut out 126. In the illustrated configuration, the front wall 116 includes a cut out 126 at each end of the front wall 116. As will be described, the cut-outs 126 accommodate portions of the operative unit 102. The cut-outs 126 can have any suitable configuration. In the illustrated configuration, however, the cut-outs 126 closely align with corresponding surfaces of the operative unit 102.

The rear wall 118 can include a vent feature 128. In the illustrated configuration, the vent feature 128 comprises a u-shaped opening. The vent feature 128 can be sized and configure to accommodate the placement of an airflow outlet from the operative unit 102. The vent feature 128 aligns with the airflow outlet from the operative unit 102 when the operative unit 102 and the base 104 are connected together and when the operative unit 102 is in position for a sharpening operation. The illustrated vent feature comprises a u-shaped or c-shaped recess that extends downward from an uppermost edge of the rear wall.

The right side wall 112 can include a right mount 130 and the left side wall 114 can include a left mount 132. The mounts 130, 132 can be configured in any suitable manner keeping in mind a desire to support the operative unit 102 using the base 104. In the illustrated configuration, the mounts 130, 132 define saddles. The saddles have generally C-shaped ledges 134, 136 with outer walls 138, 140. The ledges 134, 136 extend laterally outward from the right side wall 112 and the left side wall 114 of the base 104. The ledges 134, 136 in the illustrated configuration extend between the walls 138, 140 and the walls 112, 114 respectively.

Operative Unit

As discussed above, the operative unit 102 includes assemblies for gripping an ice skate blade, for sharpening the skate blade, and for controlling the skate sharpener 100. The illustrated operative unit 102 generally comprises a central body 200, a right end cap 202 and a left end cap 204. The end caps 202, 204 can be secured to the central body 200 in any suitable manner. In the illustrated configuration, the end caps 202, 204 are secured to the central body using threaded fasteners.

The central body 200 comprises a forward shelf 210 and a rear housing 212. The forward shelf 210 can be secured to the rear housing 212 in any suitable manner. In the illustrated configuration, the rear housing 212 has a lip that overlies a rear portion of the forward shelf 210 and the forward shelf 210 and rear housing 212 are secured together with threaded fasteners from the bottom. In some configurations, the forward shelf 210 is formed as an extrusion that can be cut to length in serial production. In some configurations, the rear housing 212 is formed as an extrusion that can be cut to length in serial production. The end caps 202, 204 span the juncture between the forward shelf 210 and the rear housing 212.

The illustrated operative unit 102 comprises a pair of biasing assemblies 220, 222. The illustrated biasing assemblies 220, 222 protrude outward from the end caps 202, 204. The biasing assemblies 220, 222 and the mounts 130, 132 of the base 104 are sized and configured such that the biasing assemblies 220, 222 can be received within and supported by the mounts 130, 132. At least a portion of the biasing assemblies 220, 222 and the mounts 130, 132 are secured against significant relative rotation. In the illustrated configuration, each of the mounts 130, 132 includes a respective pocket 224, 226. Each of the biasing assemblies 220, 222 incorporates a protuberance 230, 232. The protuberances 230, 232 are received within the respective pockets 224, 226. The interaction between the protuberances 230, 232 and the pockets 224, 226 limits relative rotation between at least those portions. In some configurations, the protuberances can be formed along the mounts and the biasing assemblies incorporate a pocket. Other configurations also can be used to limit the relative rotation between at least those portions.

Figure 9:
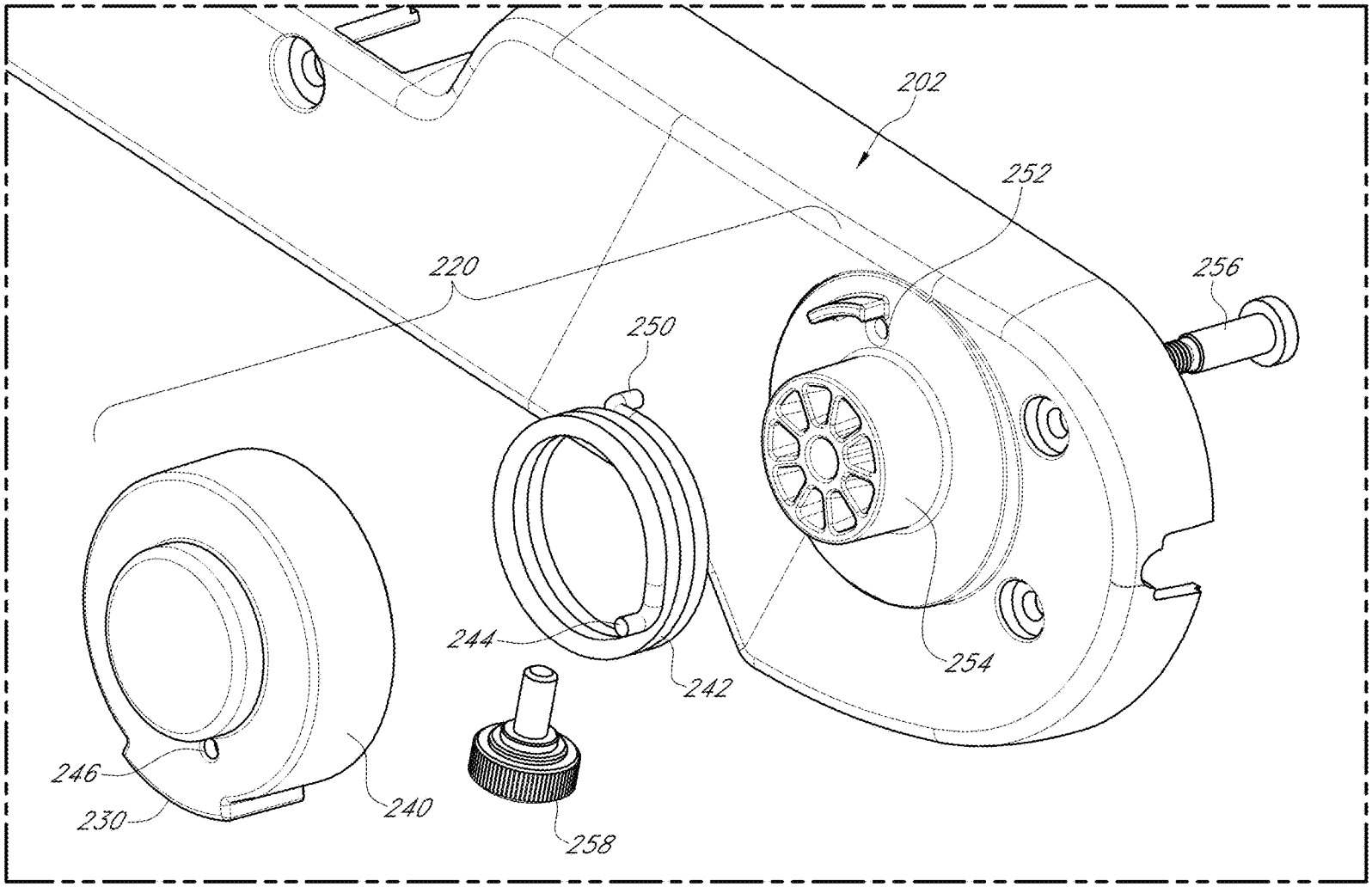
FIG. 9 is an exploded view of a biasing arrangement of the skate sharpening system of FIG. 1.

With reference now to FIG. 9, the biasing assemblies 220, 222 will be described with reference to the right biasing assembly 220. In the illustrated configuration, the left biasing assembly 222 is a mirror image of the right biasing assembly 220 and includes the same components. Moreover, while the illustrated biasing assemblies are mounted to the operative unit and locked to the base, it is possible to reverse this configuration such that the biasing assemblies are mounted to the base and locked to operative unit. The biasing assemblies exert a biasing force between the base and the operative unit. The biasing assemblies exert a pivotal biasing force in some configurations.

The illustrated biasing assembly includes a cover 240. The cover 240 includes the protuberance 230. The cover 240 has a cup shape that accommodates a torsion spring 242. The torsion spring 242 includes a first leg 244 that is received within a hole 246 formed in the cover 240. The torsion spring 242 also includes a second leg 250 that is received within a hole 252 formed in the right end cap 202. A hub 254 extends outward from the right end cap 202 and the torsion spring 242 surrounds at least a portion of the hub 254. The cover 240 is secured to the right end cap 202 by a threaded fastener 256 (e.g., a thumbscrew) but the right end cap 202 is capable of pivoting movement relative to the cover 240.

When the biasing assembly 220 is received within the mount 130, a thumbscrew 256 extends through an opening in the ledge 134 and engages with a threaded opening formed in the cover 240. In this way, the biasing assembly 220 is secured to the base 104. The cover 240 does not pivot relative to the base 104. The operative unit 102, including the right end cap 202, pivots relative to the cover 240. The torsion spring 242 unloads a biasing force as the operative unit 102 is pivoted into an opened position and the torsion spring 242 loads a biasing force as the operative unit 102 is pivoted into a closed position. The torsion spring 242 helps to control a rate of descent of the operative unit 102 as the operative unit 102 moves between the open position and the closed position. In some configurations, the torsion spring 242 provides a sufficient biasing force to oppose final closure of the operative unit 102 against the base 104 without a force input by a user. In some configurations, the torsion spring 242 provides less resistive force such that the operative unit 102 will fully close against the base 104 without a force input by a user but the torsion spring 242 provides at least some opposition to the closure.

In some configurations, a prop rod can provide means for securing the operative unit 102 in an open position. The prop rod can hold the operative unit 102 in one or more open orientations relative to the base 104. The prop rod may be in addition to the biasing assembly or the prop rod may be an alternative to the biasing assembly. In some configurations, the cover 240 (or an analog for the cover 240) can be formed to have a hexagonal shape, for example but without limitation, while the corresponding mount 130 can have a complementary shape such that the operative unit 102 can be lifted from the base 104, pivoted and then returned to the base at a different angle. In such a configuration, there is no need for the biasing assembly, for example. In such a configuration, the operative unit 102 may not be secured to the base 104 to oppose relative vertical movement between the operative unit 102 and the base 104.

Another possible configuration that allows for the removal of the biasing assembly is adjusting the pivot location such that the pivot location is near a center of gravity of the operative unit. If the pivot location was moved closer to the center of the side walls of the base 104, then the bucket height would need to increase but lighter springs could be used. Such a configuration, however, may not be a desired tradeoff. In some configurations, the pivot location can intersect with the rear wall or a structure that extends from the rear wall. The illustrated pivot location was designed to facilitate a low profile for the base (and the overall system). As shown in FIG. 10, there is a curvature along the sides of the base 104. The operative unit 102 has a complementary curved shape. These curves follow the center of rotation such that, when the operative unit 102 is in a closed position, a minimal amount of clearance exists between the base 104 and the operative unit 102.

Reduced clearance between the walls reduces the likelihood of bypassed airflow, which allows increased airflow through the slot 150 that receives the skate (such that more of the swarf and dust can be pulled into the base 104). The system operates under vacuum; the fan pulls air into the base 104 and then exhausts that air through the back of the operative unit. The air is replaced primarily by air flowing in through the skate slot 150. This flow of air will capture the swarf/dust from the grinding. While seals could be used to seal the gaps between the base 104 and the operative unit 102, the variety of environments in which the system 100 may be used, such as those with a wide operating temperature swings, can make seal optimization difficult. Such seals also may increase friction and would increase costs.

Operative Unit Positioning Locks

Figure 3:
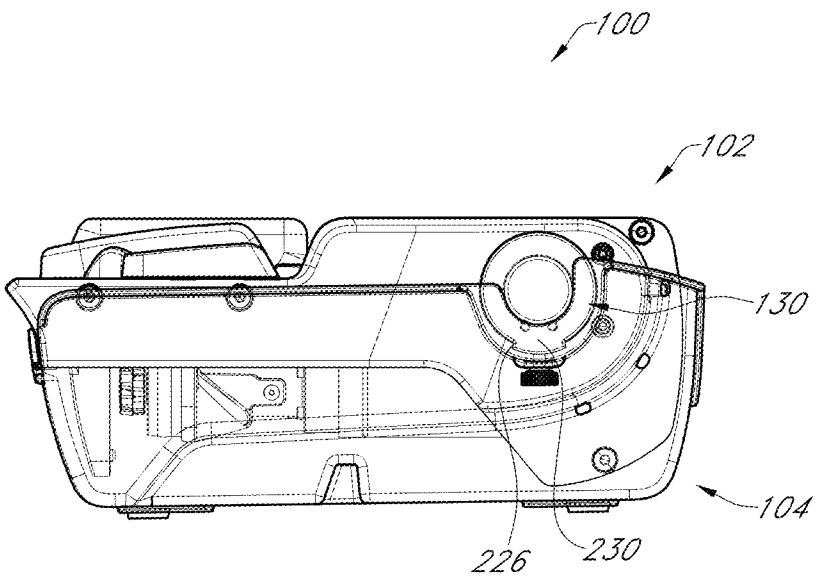
FIG. 3 is a right elevation view of the skate sharpening system of FIG. 1.
Figure 4:
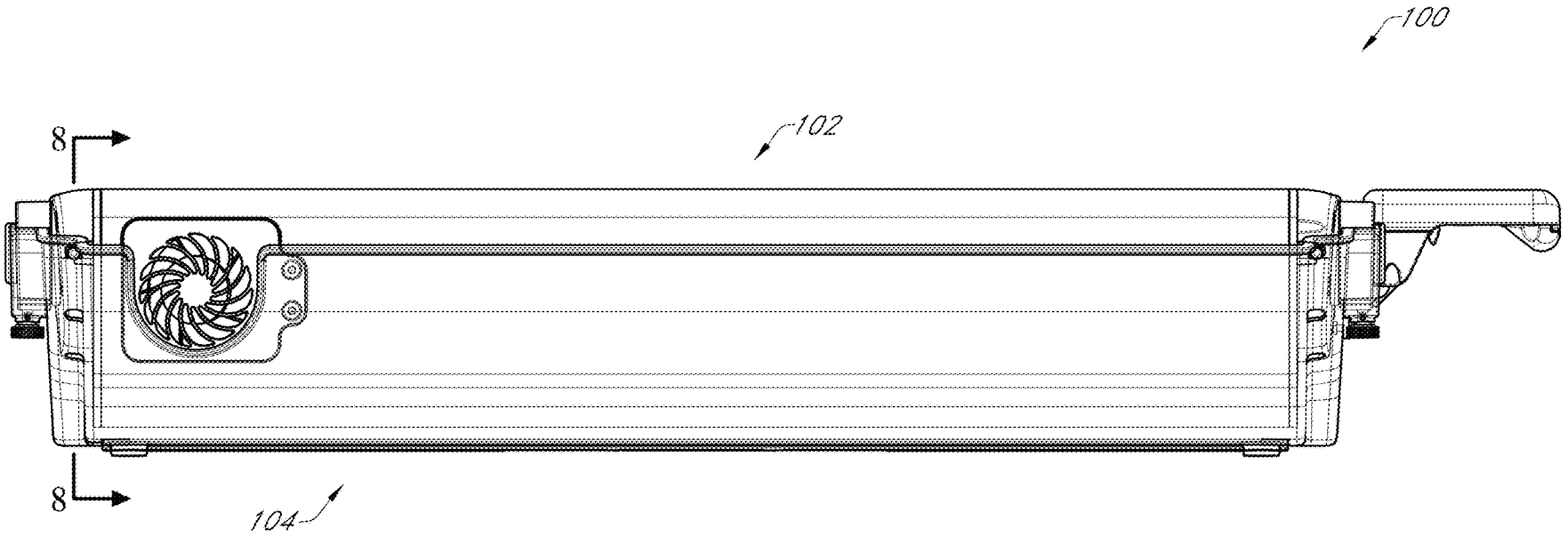
FIG. 4 is a rear elevation view of the skate sharpening system of FIG. 1.
Figure 11:
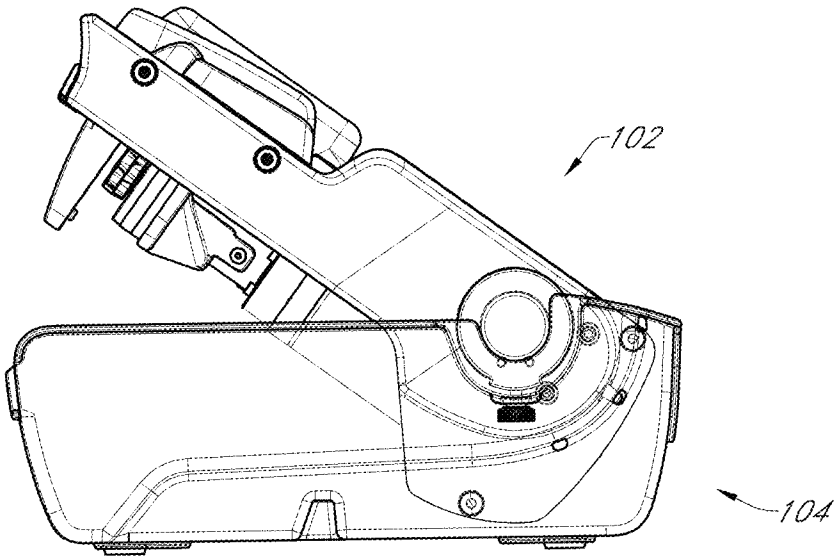
FIG. 11 is a side view with the operative unit pivoted to a first open position relative to the base.
Figure 12:
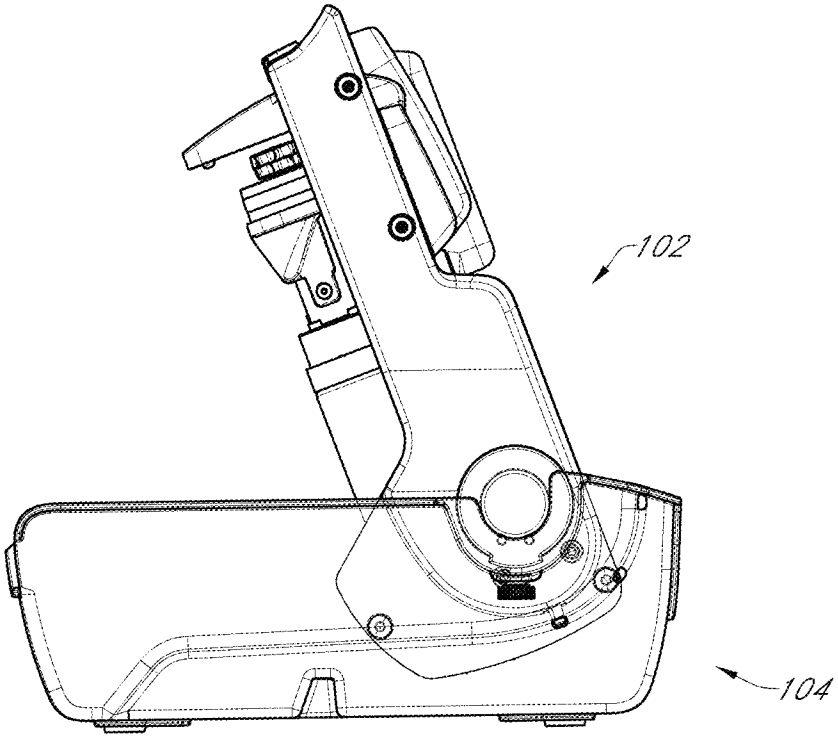
FIG. 12 is a side view with the operative unit pivoted to a second open position relative to the base.

With reference to FIGS. 3, 11, and 12, the operative unit 102 and the base 104 are pivotally connected. To adjust the grinding wheel 340, to replace an air filter, or to remove the dust collected during sharpening operations, the operative unit 102 can be pivoted to an open position, such as shown in FIGS. 11 and 12. The operative unit 102 exceeds 15 pounds in weight in the illustrated configuration. As discussed directly above, a biasing assembly can be used to assist with the raising and lowering of the operative unit 102 relative to the base 104. In some configurations, means for securing the operative unit 102 in an open position can be provided. As discussed above, the means for securing can include a prop rod that holds the operative unit 102 in a particular open orientation relative to the base 104, a biasing assembly that supplies sufficient biasing force to maintain the operative unit 102 in an open orientation relative to the base 104, or a mechanical locking configuration that provides physical stops to secure the operative unit 102 in one or more particular open orientations relative to the base 104, for example but without limitation.

Figure 8:
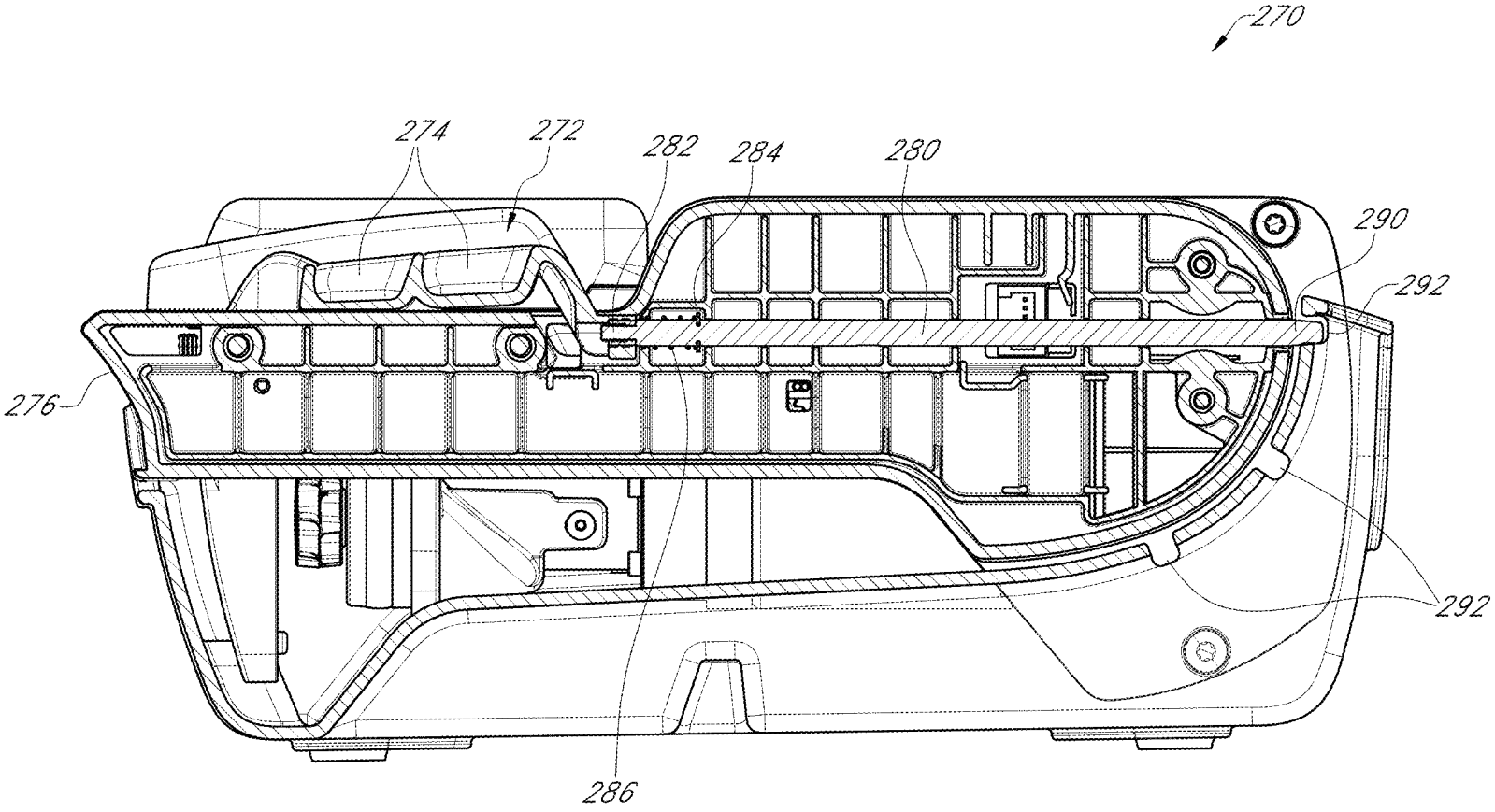
FIG. 8 is a sectioned view of the skate sharpening system of FIG. 1.

A mechanical locking configuration 270 is shown in FIG. 8. While only the right side mechanical locking configuration 270 will be shown, a mirror image of the illustrated mechanical locking configuration 270 can be used on the left side. In some configurations, only one side has the locking configuration.

Figure 2:
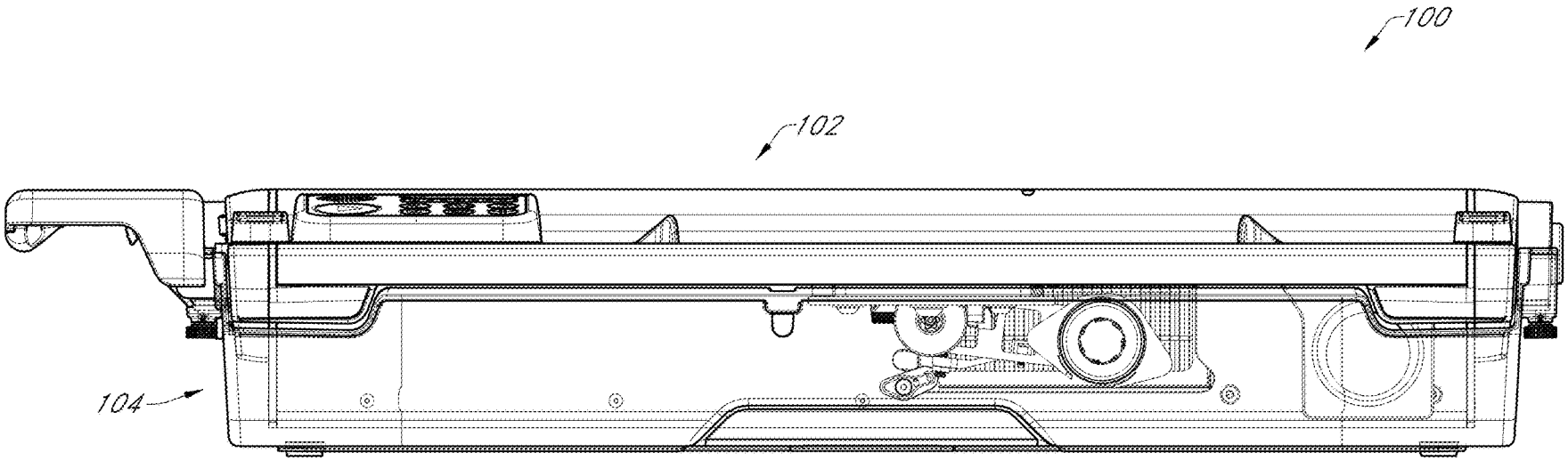
FIG. 2 is a front elevation view of the skate sharpening system of FIG. 1.

The illustrated mechanical locking configuration 270 comprises a trigger 272. In some embodiments, another suitable mechanism, such as a button, latch, slide, switch, knob, pin, or other mechanism can be used to replace the trigger to actuate the mechanical locking configuration 270. The trigger 272 can include one or more grip locations 274. The grip locations 274 can be configured to receive one or more fingers of the user. A thumb pad 276 can extend a short distance along a front of the system 100. The short thumb pad 276 reduces any impact on visibility into the system 100; if an elongated thumb pad 276 extended a full length of the front of the operative unit 102, the height of the overall system 100 may need to be increased to provide a desired level of access and vision. As shown in FIG. 2, in the illustrated configuration, the thumb pad 276 extends less than 1/10 of the full length of the operative unit 102. In some configurations, the thumb pad extends to less than or equal to one half of the full length of the operative unit 102. In some configurations, the thumb pad 276 is integrally formed with the end caps 202, 204. Such configurations advantageously facilitate forming the central body 200 of extrusions.

Together with the thumb pad 276 that is located forward of the trigger 272 and lower than the trigger 272, the grip locations 274 can guide a user to a desired placement of their hand while operating the mechanical locking configuration 270. In some configurations, as discussed above, two mechanical locking configurations 270 are provided such that both of the mechanical locking configurations 270 must be operated at the same time to pivot the operative unit 102 relative to the base 104. Such configurations help to reduce pinching risks in an advantageous manner.

With reference again to FIG. 8, a rod 280 connects to the trigger 272. In the illustrated configuration, the rod 280 has a threaded end 282 that engages with threads of the trigger 272. A circlip 284 and a spring 286 provide a return force that opposes unlocking movement of the trigger. 272. The spring 286 is captured between an internal surface of the end cap 202 and the circlip 284. Other configurations are possible to provide the biasing force to the mechanical locking configuration 270. In some less desired configurations, the biasing force is omitted.

In the illustrated configuration, an engagement tip 290 of the rod 280 extends beyond the end cap 202 to engage a recess 292 formed in the base 104. The base 104 can comprise one or more recess 292 that correlates to the one or more positions of the operative unit 102 relative to the base 104 that is desired to be maintained. In the illustrated configuration, the operative unit 102 can be secured in any of three positions relative to the base 104 and, accordingly, three recesses 292 correlated to those positions. In the illustrated configuration, the first recess 292 corresponds to a closed position, the second recess 292 corresponds to the position shown in FIG. 11, and the third recess 292 corresponds to the position shown in FIG. 12. The position in FIG. 11 allows for access to the grinding wheel 340 and for adjustment of the position of the grinding wheel 340. The position in FIG. 12 allows for more complete access to the interior of the base 104 for cleaning and allows for improved access to a filter assembly for replacement of the filter.

The biasing elements on the rod/trigger assembly could be omitted and a pin or the rod could simply be inserted into the recess such that the operative unit can be pivoted and secured in a desired position (e.g., pin and overlapping hole assemblies). Other locking arrangements (e.g., interference components, frictional components, adjustable friction components, adjustable interference components) also are possible to allow the operative unit to be secured in different pivotal positions relative to the base. In some configurations, the operative unit 102 may be configured to lock in position relative to the base 104 by tightening the end caps 202, 204 and locking the unit at any height position. In other words, the end cap 202 could be tightened down by the user and, as the end cap 202 gets tighter, friction locks-out rotation of the operative unit 102 relative to the base 104.

Description of Grinding Wheel and Arbor Shroud

Figure 13:
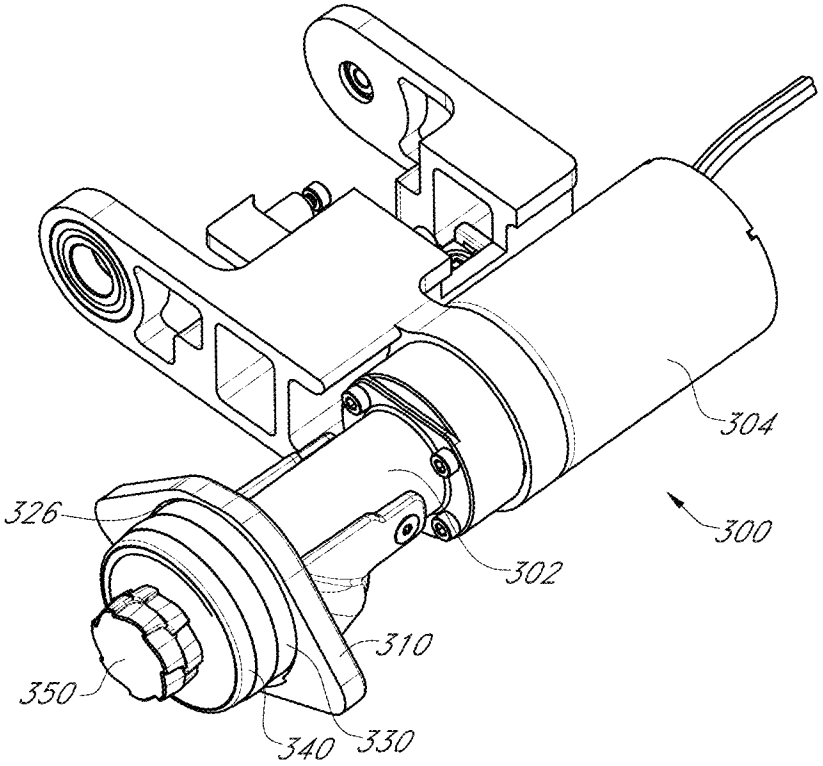
FIG. 13 is a perspective view of the spindle assembly of the skate sharpening system of FIG. 1.
Figure 14:
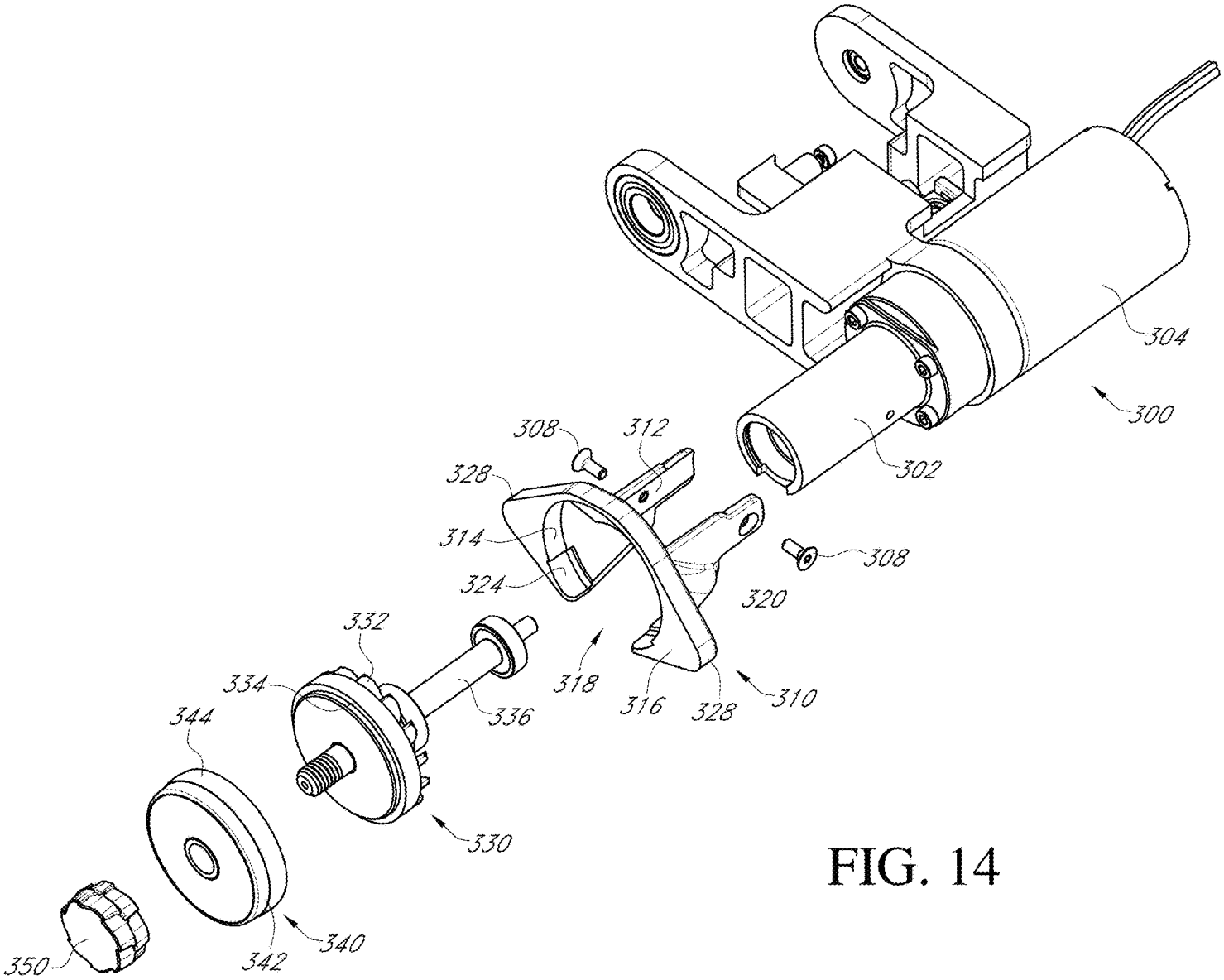
FIG. 14 is an exploded view of the spindle assembly of the skate sharpening system of FIG. 1.

FIGS. 13 and 14 show an embodiment of the grinding wheel and spindle assembly 300. The grinding wheel 340 includes a metal grinding ring 344 disposed on a rigid hub 342. The grinding wheel 340 is mounted to an axle 336 of the spindle 302 by a retention nut 350 that urges the grinding wheel 340 against a metal arbor 330 that forms part of the spindle 302. The grinding ring 344 has an abrasive outer surface for removing material from a skate blade during a sharpening operation.

As shown, both the arbor 330 and hub 342 have shaped outer edges which mate with respective edges of the grinding ring 344. The mating between the arbor 330 and grinding wheel 340 is a sliding contact mating that permits mounting and dismounting of the grinding wheel 340 while also providing for heat transfer between the grinding ring 344 and the arbor 330. The heat transfer helps dissipate frictional heat generated in the grinding ring 344 as it rotates against a skate blade in operation. Specifically, this mating is between a portion of an inner annular surface of the grinding ring 344 and an annular outer rim 334 of the arbor 330. Both the hub 342 and arbor 330 have notches or shoulders on which respective portions of the grinding ring 344 rest. Thus, the shoulder portion of the hub 342 extends only partway into the grinding ring 344, so that a remaining part of the grinding ring 344 extends beyond the arbor-facing end of the hub 342 and mates with the shoulder portion of the arbor 330.

The arbor 330 can include vanes 332 or other features to increase its surface area and/or enhance air flow for a desired cooling effect, further promoting heat dissipation and helping to maintain a desired operating temperature of the grinding ring 344 in operation. The vanes 332 can provide a conductive and convective cooling effect. One challenge of the geometry and size of the grinding ring 344 is heat removal, and this can be addressed in part by the heat-conducting mating with the arbor 330 and heat-dissipating features of the arbor 330.

Arbor Shroud

Figure 15:
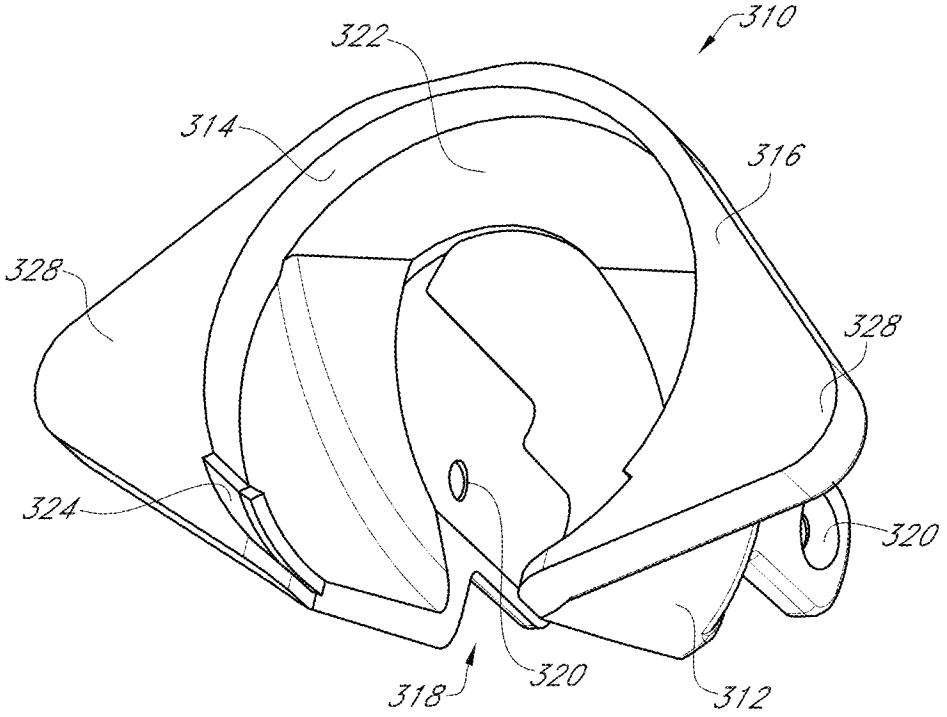
FIG. 15 is a perspective view of the arbor shroud of the skate sharpening system of FIG. 1.

The arbor shroud 310 is further illustrated in FIG. 15. In the illustrated embodiment, the arbor shroud 310 includes a body portion 312, a sidewall 314 defining a shroud opening, a front wall 316 defining jaw protection features 328, a lower opening 318, fastener openings 320, back wall 322, and recessed walls 324.

The body portion 312 extends distally from the front wall 316. The body portion 312 is configured to be mounted on the spindle 302. The body portion 312 comprises leg portions that extend distally from the front wall 316 and are configured to be secured to the spindle 302. Each leg portions extends circumferentially about a portion the spindle 302. In the illustrated embodiment, the body portion 312 includes fastener openings 320 configured for attaching the shroud 310 to the spindle 302 using fasteners 308. In the illustrated embodiment, the legs are substantially symmetric with offset fastener openings 320. The fastener openings 320 are offset from each other in elevation to stabilize the shroud 310 when secured to the spindle 302. The shroud 310 is configured to remain stationary with the spindle 302 and does not rotate with the grinding wheel 340 or the arbor 330. In some embodiments, the body may be formed as a single leg that extends about a portion of the circumference of the spindle 302. In some embodiments, the shroud 310 may be secured in place by a single fastener and a protuberance or other feature to help secure the position and prevent rotation. In some embodiments, the shroud 310 may include members that snap into corresponding positions on the spindle 302. In some embodiments, the shroud 310 may be mounted on a different portion of the carriage assembly that remains stationary relative to the rotation of the arbor 330 and grinding wheel 340. The recessed walls 324 can provide structural rigidity and help prevent the lower portion of the shroud 310 from contacting the arbor 330. In some embodiments, the shroud 310 may be formed as part of the spindle 302.

In the illustrated embodiment, the shroud 310 is formed as a single molded part. In some embodiments, the shroud 310 may be formed from two or more separate pieces. The shroud 310 may be coupled to the spindle 302 using other means known in the art. Some desired materials from which the shroud 310 can be formed include, but are not limited to, Nylon, Glass-filled nylon, or POM.

The sidewall 314 and back wall 316 form a shroud opening in the front wall 316 that is configured to cover at least the vanes 332 of the arbor 330. The shroud opening can be concentric with the arbor 330 when coupled to the spindle 302. The shroud 310 is configured such that it can be installed on the spindle 302 before or after the installation of the arbor 330. The shroud opening is configured to be larger than the diameter of the arbor 330 so that the arbor 330 can freely rotate without contacting the sidewall 314. The shroud opening can have a diameter that is greater than the diameter of the arbor 330. When the shroud 310 installed, a gap 326 is formed between the sidewall 314 and annular outer rim 334 and vanes 332 of the arbor 330. The width of the side wall 314 can cover at least a portion of the vanes 332. The width of the side wall 314 can be as wide as or greater than the width of the vanes 332 of the arbor 330. The width of the front wall 316 can be substantially the same as the width of the sidewall 314. The width of the front wall 316 of the shroud 310 is configured so that, when installed, it can fit between within the opening of the skate slot 150 with the grinding wheel 340 and arbor 330 (such as illustrated in FIG. 3). In some configurations, the width of the front wall 316 can be between 0.2 and 2 mm. The shroud 310 can include a back wall 322 configured to be separated from the vanes 332 during operation. In the illustrated embodiment, the back wall 322 has a flat portion and angled portions that extend distally away and downward. The back wall 322 can be configured to help direct the airflow from the arbor 330 during operation. The side wall 314 forms the lower opening 318. In some configurations, the lower opening 318 can be up to 50% of the circumference of the opening. The opening 318 is configured to allow sufficient air to flow through and away from the arbor 330. In combination with the shape of the back wall 322, air can be directed downward and away from the arbor 330 and grinding wheel 340. The configuration of the lower opening 318 can help to effectively dissipate heat for cooling of the grinding wheel 340 during operation. In some configurations, the back wall 322 can include one or more openings to provide additional airflow for heat dissipation. In some configurations, the sidewall 314 can form an opening having a different shape, for example, the shroud opening may have a U-shape or other shaped opening. The gap between may not be uniform between the side wall and the arbor 330. In some embodiments, the shroud 310 may be formed using a screen or fence-like construction. In such an embodiment, the screen can provide the same functionality of the walls of the shroud 310. The screen can provide airflow through the arbor 330, while also preventing access by the user with arbor 330 during operation of the skate sharpener.

Protective Cover for Arbor

Figure 5:
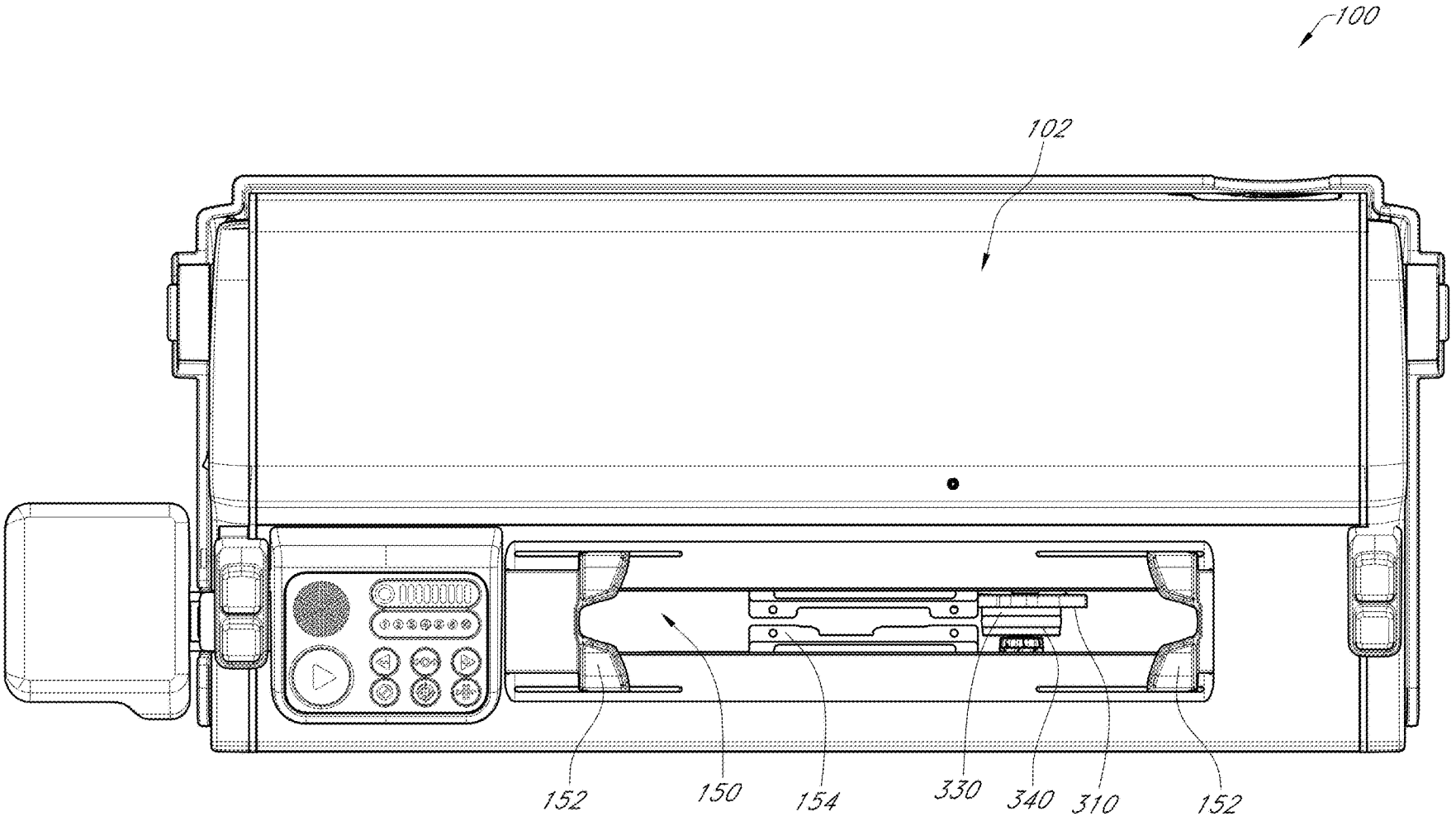
FIG. 5 is a top view of the skate sharpening system of FIG. 1.
Figure 6:
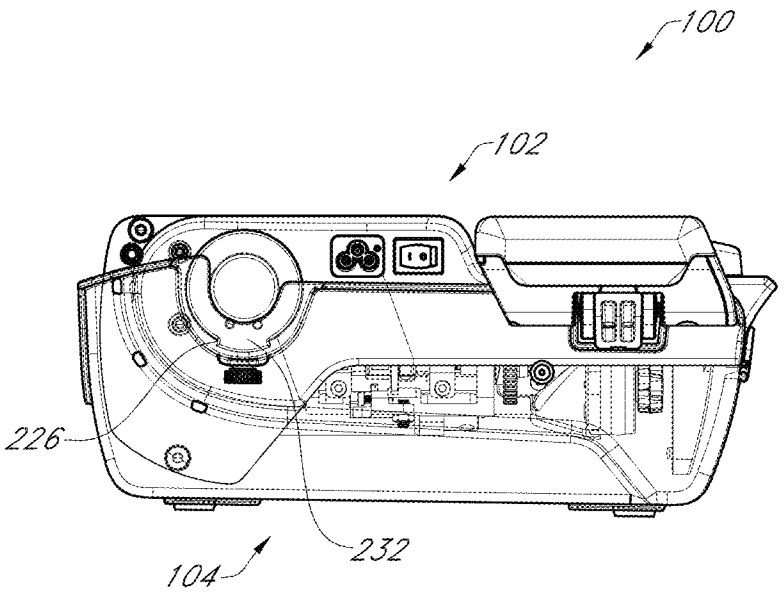
FIG. 6 is a left elevation view of the skate sharpening system of FIG. 1.

The shroud 310 provides a protective cover over at least a portion of the arbor 330. The shroud 310 can cover at least a portion of the vanes 332 of the arbor 330. In some configurations, the shroud 310 may cover the width of the vanes 332 or may be wider and extend over a larger portion of the arbor 330. In some configurations, the shroud 310 can extend up to the thickness of the arbor 330, to the extent that the shroud 310 does not interfere with the grinding operation. The grinding wheel 340 and arbor 330 can be accessed from the topside of the sharpening unit and are sized to fit between with the walls of the skate slot 150 (such as illustrated in FIG. 5). The positioning of the shroud 310 is configured to prevent human interaction with the arbor 330, such as with the vanes 332 of the arbor 330, during operation of the skate sharpener. The shroud 310 helps to prevent accidental or intentional interaction with the arbor 330 during operation. Additionally, the shroud 310 can help to prevent sparks and swarf from escaping upwards during the sharpening operation and instead be captured by and within the base 104.

Jaw Protection Feature

Figure 16A:
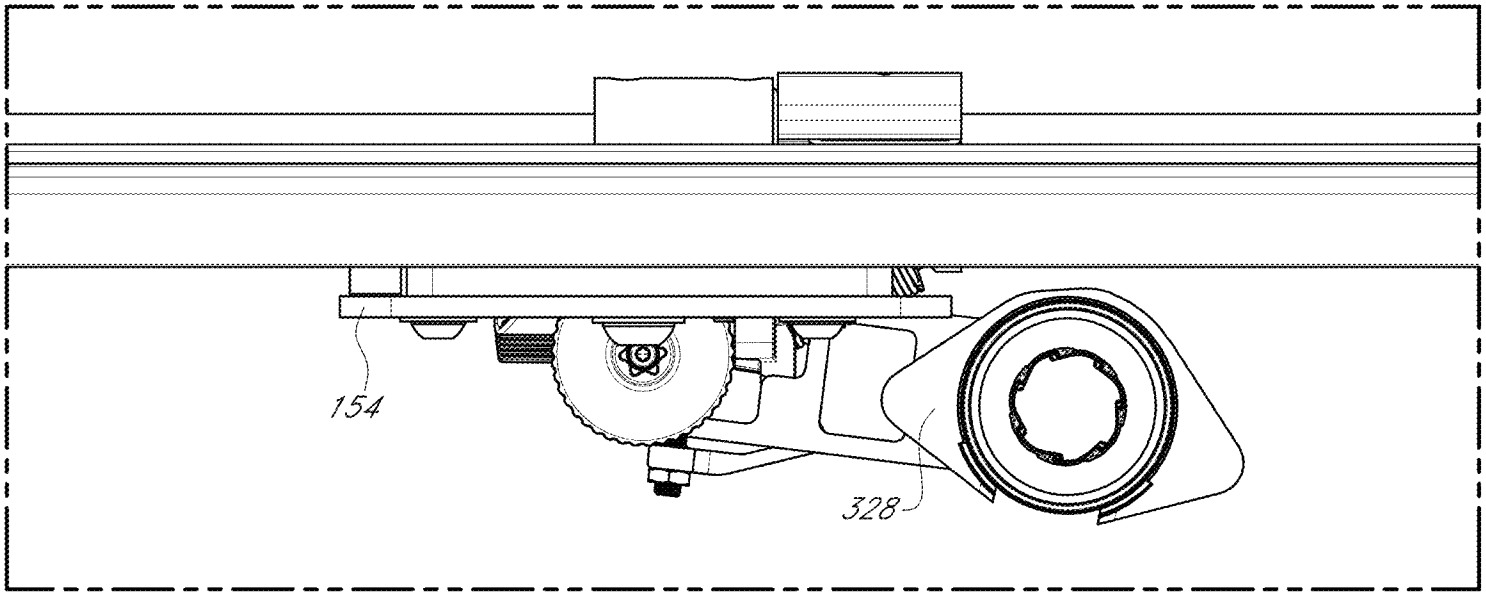
FIGS. 16A, 16B, and 16C are front views of skate sharpening system illustrating movement of the grinding wheel within the skate sharpening system of FIG. 1.
Figure 16B:
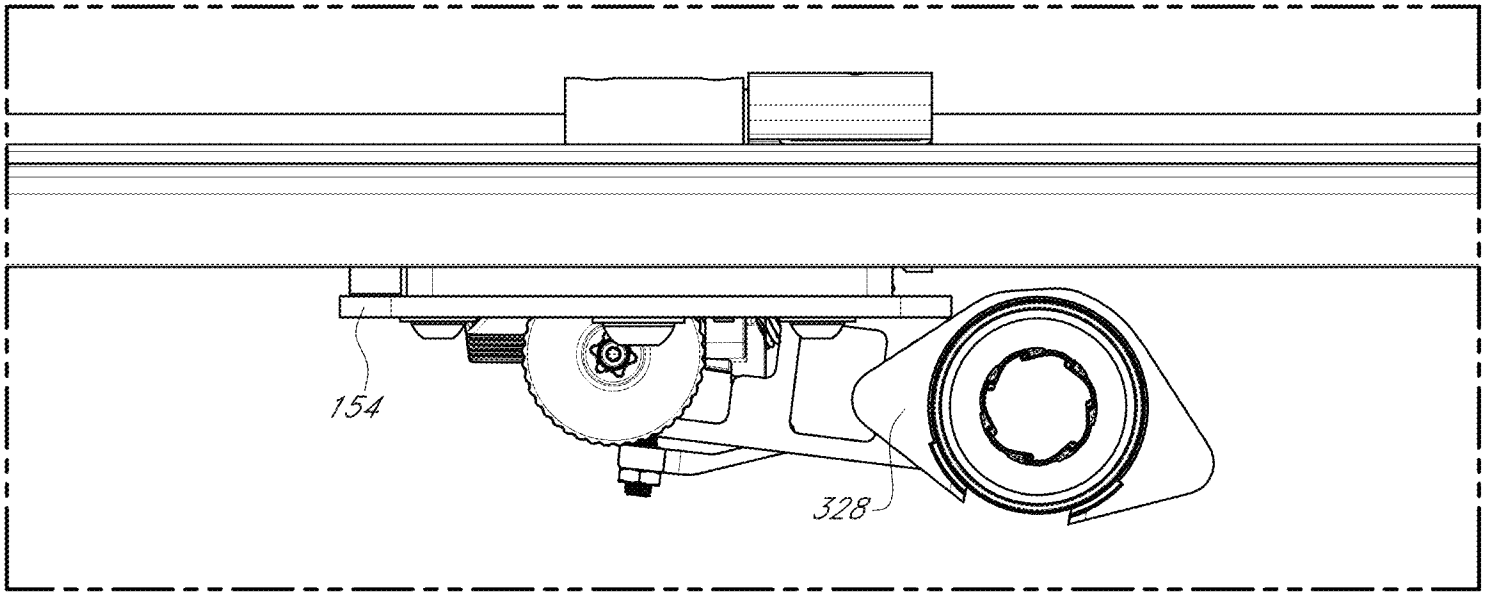
Figure 16C:
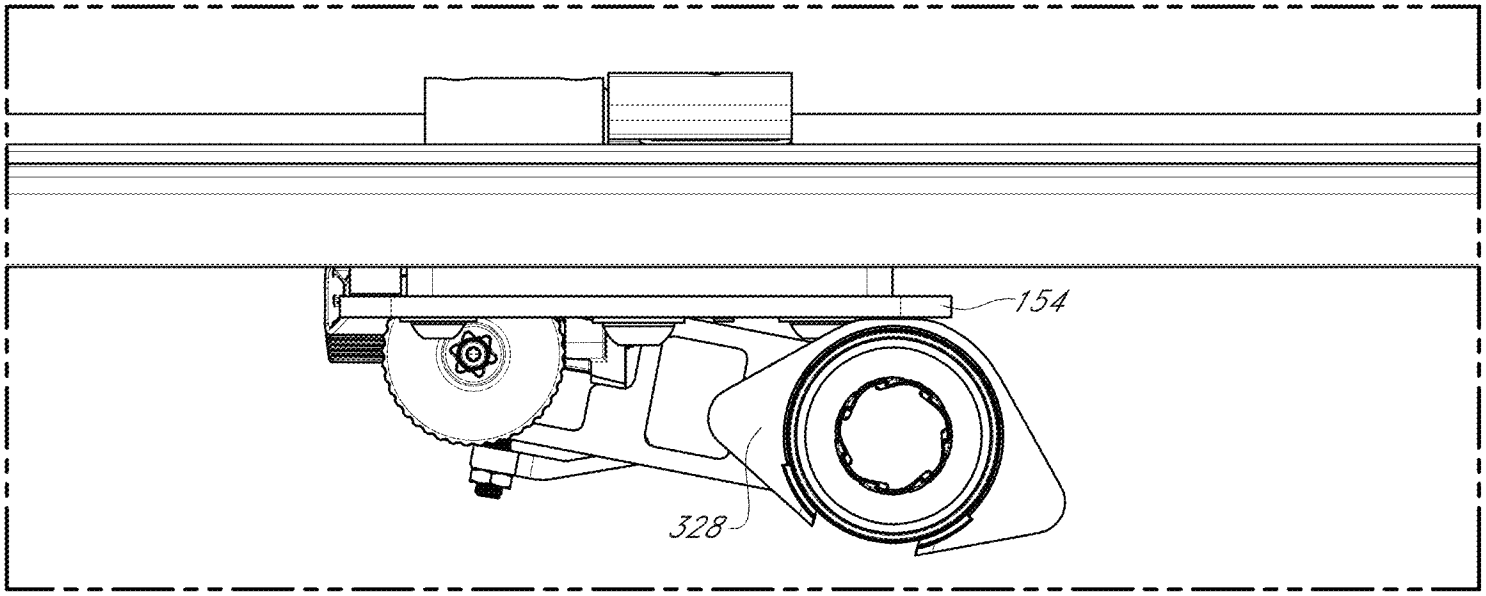

With additional reference to FIGS. 16A-16C, the functionality of lobes 328 is illustrated. The front wall 316 forms lobes 328 on both sides of shroud 310. If the sharpener were to operate without a skate between the jaws, the grinding wheel 340 could potentially grind a portion of the jaws. The lobes 328 are configured to prevent the grinding wheel 340 from contacting components of the skate sharpener when it is operated without a skate blade inserted in the blade slot 150 and secured by blade retention jaws 154. The lobes 328 are configured to act as a ramp when the carriage moves laterally in the x direction during operation. When the lobes contact a lower surface of the jaws 154 (FIG. 16B), the grinding wheel 340 is displaced downward in the z direction (FIG. 16C). The downward displacement prevents contact between the grinding wheel 340 and the jaws 154. The lobes are disposed on both sides of the shroud 310 so that the ramp will function while the grinding wheel 340 is operating in either direction during the sharpening operation. The upper wall of the shroud 310 may include a portion that is substantially flat, the flat portion is configured to slide along the lower surface of the jaws, as illustrated in FIG. 16C. In the illustrated embodiment, the jaw protection features 328 are illustrated as triangular lobes on the shroud 310. In other embodiments, the jaw protection features 238 may have a different shape or appearance. In some embodiments, the jaw protection feature is included on a single side.

Zero Backlash System

Figure 17:
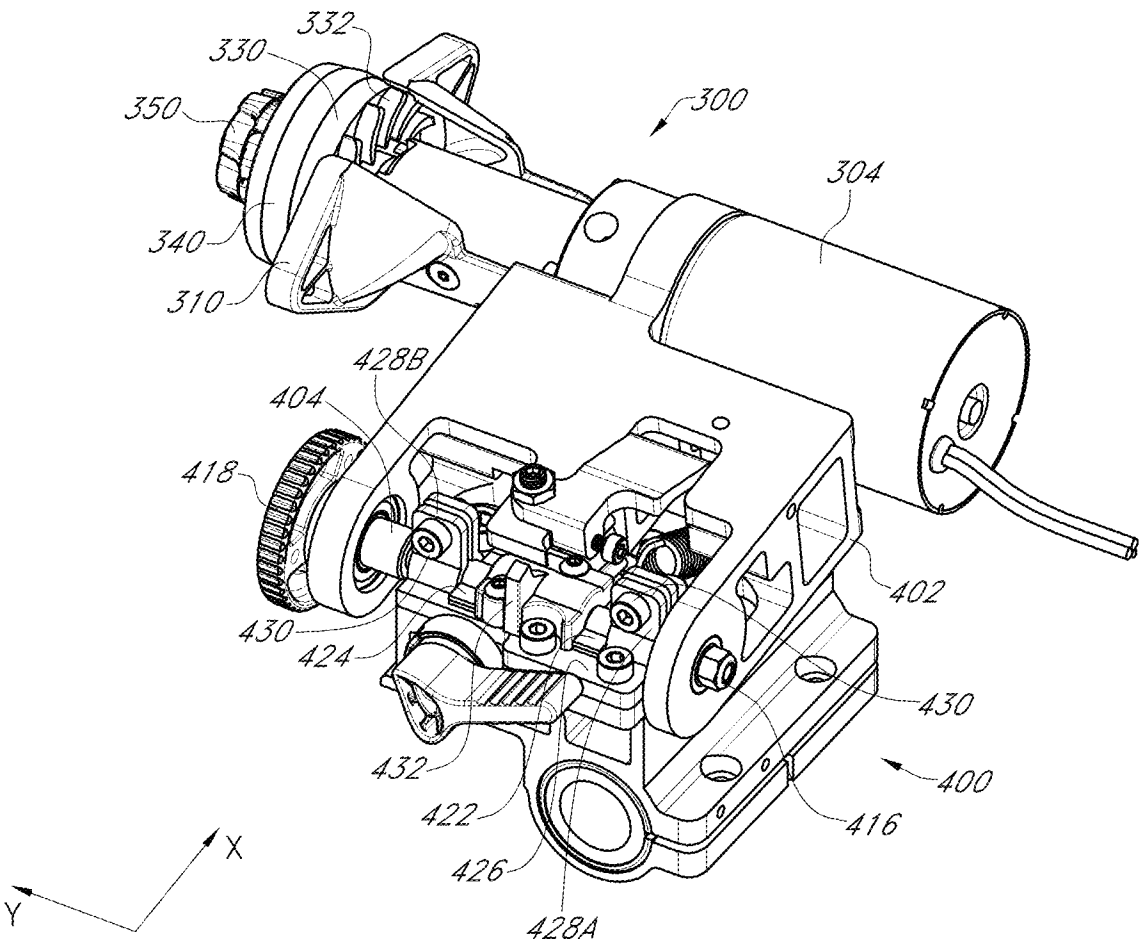
FIG. 17 is a perspective view of the spindle assembly and carriage assembly of the skate sharpening system of FIG. 1.
Figure 18:
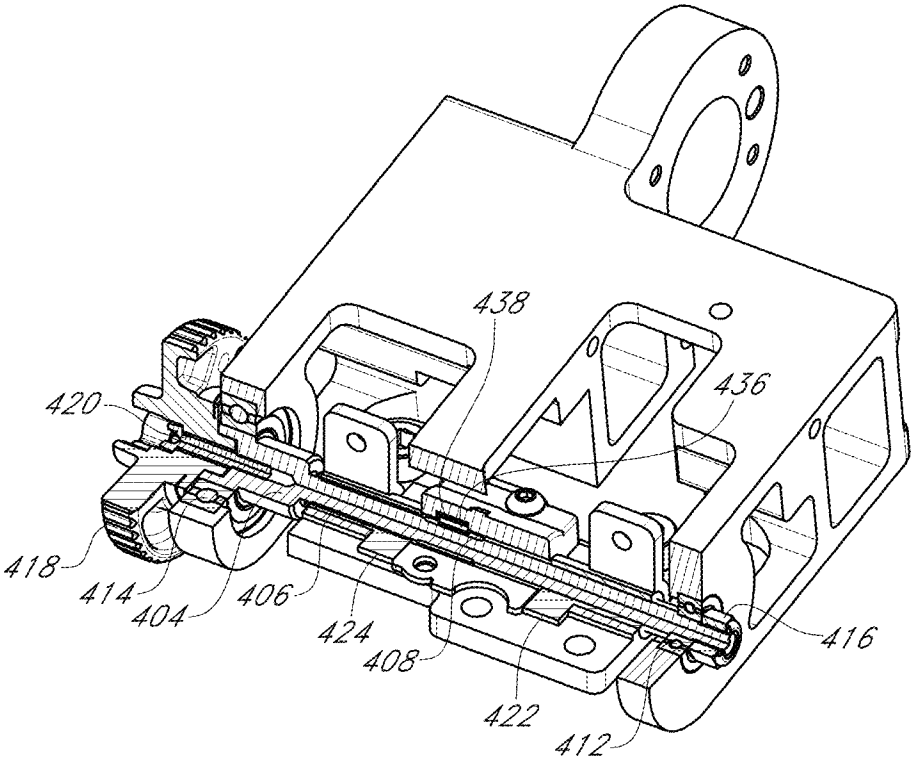
FIG. 18 illustrates a partial section view of the carriage assembly of the skate sharpening system of FIG. 1.
Figure 19:
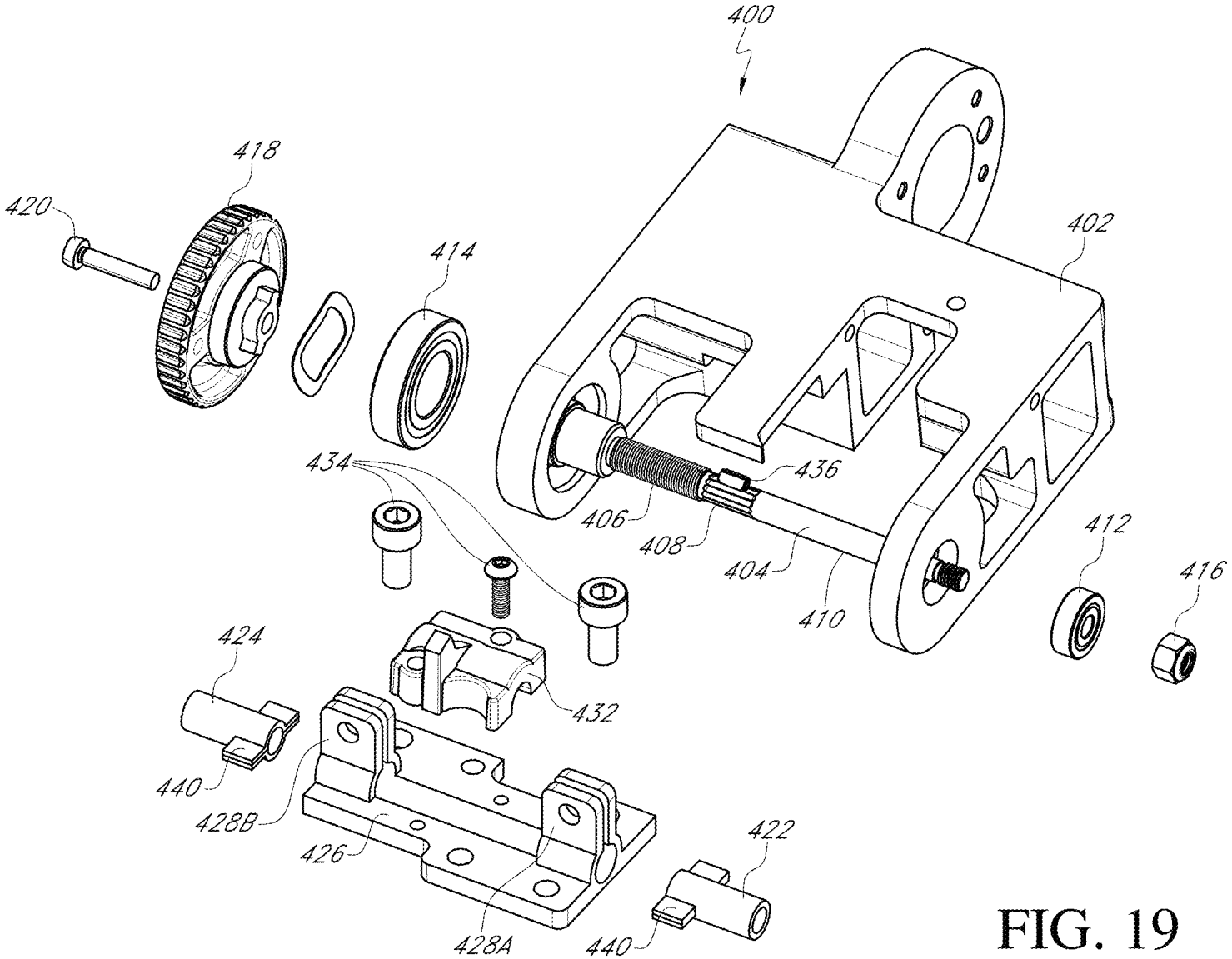
FIG. 19 illustrates an exploded view of components of the carriage assembly of the skate sharpening system of FIG. 1.

FIGS. 17-19 illustrate aspects of the grinding wheel alignment system. Specifically, the alignment system positions the grinding wheel 340 relative to the position of a skate blade inserted within blade slot 150. The alignment system provides for the movement of the grinding ring along the y axis without backlash. Backlash is a common and undesired mechanical problem inherent in threaded or geared mechanisms. FIG. 17 is a perspective view of the grinding wheel assembly 300 and carriage assembly 400. FIG. 18 illustrates a partial section view at the location of the alignment shaft 404. FIG. 19 illustrates an exploded view of components of the carriage assembly 400.

The alignment shaft 404 is secured at each end to the carriage 402. Shown on the left, the shaft 404 is secured in place by the end fastener 420 having screw threading corresponding to threading on an internal opening of the shaft 404. The end fastener 420 secures an adjustment knob 418, and bearing 414 in place on the left side of the carriage 402. Shown on the right is a nut 416 having screw threading engaging corresponding screw threading on the alignment shaft 404. Arranged between the nut 416 and the shaft is a bearing 412. The alignment shaft 404 includes a threaded portion 406, a detents portion 408, and an unthreaded portion 410. The detents portion 408 includes a plurality of detents disposed circumferentially about the shaft. The detents of the shaft extend along a longitudinal portion of the shaft between the threaded portion 406 and the unthreaded portion 410. The detents are sized and configured to engage the spring pin 436. The spring pin 436 has a fixed position and rides in the series of detents or recesses in the outer diameter of the shaft 404. As the adjustment knob 418 is manipulated, each movement of the detents relative to the spring pin 436 corresponds to a single tactile and/or audible click of the adjustment wheel 418. In some embodiments, the spring pin may be replaced by a ball and plunger or any spring-like feature that can provide audible and/or tactile feedback of the adjustment wheel 418. In some embodiments, detents can be molded into the backside of knob 418 and a spring pin or ball plunger can be provided on the body of the carriage 402. The detent mechanism can be effectively implemented by using two surfaces in the assembly that rotate relative to each other when the adjustment knob 418 is manipulated. Each detent is sized and configured to correspond to a defined amount of movement of the grinding wheel 340 along the y-axis with each click of the adjustment wheel 418. In some configurations, each click can correspond to of an adjustment between 0.005 and 0.04 of a mm of the y-position of the grinding wheel 340. In one embodiment, a click is $1/26^{th}$ of a mm adjustment of the y-position of the grinding wheel 340. The adjustment mechanism will be further described below.

The alignment shaft 404 is further secured in place within the carriage 402 by the mounting bracket 426. The mounting bracket 426 includes compression brackets 428. The mounting bracket 426 is secured to the carriage by fasteners 434. The mounting bracket includes an axial path for the shaft 404. The threaded bushing 424 and the through hole bushing 422 are positioned within the axial path. The through hole bushing 422 is positioned at least partially within the axial opening formed in compression bracket 428A. The threaded bushing 424 is positioned at least partially within the axial opening formed in compression bracket 428B. The threaded portion 406 of the shaft 404 includes threading that corresponds to threading of the threaded bushing 424. The through hole bushing 422 can have a reamed diameter that is substantially the same as the diameter of the unthreaded portion 410 of the shaft 404. Reaming the through hole bushing can result in a more accurate fit. The through hole bushing 422 can be configured to have an interference fit with the unthreaded portion of the shaft 404. In some embodiments, only a single bushing may be used. The bushing may be a threaded bushing or a through hole bushing.

The bushings 422, 424 can include tabs 440 that are configured to longitudinally space the bushings along the axial path and prevent the bushings from rotating during operation. The shaft 404 is positioned within the axial path of the mounting bracket 426. The threaded bushing 424 is threaded onto the threaded portion 406 of the shaft 404 and positioned within the axial opening of compression bracket 428B. The through hole bushing 422 is positioned on the unthreaded portion 410 of the shaft 404 and positioned within the axial opening of compression bracket 428A. The through hole bushing 422 is a follower. The bushings 422, 424 can be formed from any suitable material but a polymer is used in this embodiment. Some desired polymers from which the bushings 422, 424 can be formed include, but are not limited to, POM (acetal), UHMW polyethylene, or Nylon.

The spacing bracket 432 is positioned between bushings 422 and 424. With respect to the shaft 404, the spacing bracket 432 is configured to be positioned over the detent portion 408. The spacing bracket 432 includes a recess 438 sized and configured to receive the spring pin 436. As described above, the spring pin 436 is configured to engage the detents in the shaft 404. The longitudinal positions of the bushings 422, 424 are secured between the spacing bracket 432 and compression brackets 428A-B by tabs 440.

The compression brackets 428A-B are configured to tighten and secure the position of the shaft 404 relative to the bushings 422, 424 When the compression brackets are secured, they cause the bushings 422, 424 to contract on the corresponding portion of the shaft 404 and secure the shaft in place. Tabs 440 on the bushings 422, 424 prevent the bushings from rotating during operation. The bushings 422, 424 apply a force on the shaft that is sufficient to prevent undesired rotation of the shaft 404, such as during a sharpening operation. However, the lubricity of the polymer material of the bushings allows the shaft 404 to rotate without binding when the adjustment knob 418 is manipulated. The compression of the bushings on the shaft 404 additionally secures the position of the shaft such that there is substantially no hysteresis, backlash, or uncertainty of location caused by rotation of the adjustment knob 418. The shaft 404 can rotate from forward to backward and visa-versa without backlash when the adjustment knob 418 is manipulated, regardless of the y-position of the grinding wheel 340. By compressing the polymer bushings, any undesired rotation is prevented. Additionally, any desired rotation is not inhibited.

In the illustrated embodiment, the adjustment knob 418 can be manipulated by a user in order to adjust the rotation of the shaft 404. In some embodiments, the adjustment knob may be configured to be manipulated by an electronically controlled alignment system. For example, the shaft may be rotated by a motor, such as a stepper or servo motor. The system may utilize a machine vision system or encoder to determine alignment. The components can be controlled by a controller.

Alignment Operation

The grinding ring is adjustable in the transverse or Y-direction. The motor arm pivots on bearing 412 and bearing 414. In some embodiments, the system can use bushings in place of bearings. The threaded shaft 404 moves the assembly in and out in the Y-direction. The Y-position of the grinding wheel assembly 300 is varied by user rotation of the adjustment knob 418. As described above, the detents 408 and spring pin 436 are co-configured to form a detent mechanism providing several detent locations for a rotation of the adjustment knob during the adjustment process. Each click of the adjustment knob provides for alignment of the grinding wheel assembly 300 by a defined adjustment amount (e.g., $1/26^{th}$ of a mm per click) of the grinding wheel 340 position in the y direction.

As the adjustment knob 418 rotates, the screw action causes the carriage assembly 400 to move transversely in the Y direction along the alignment shaft 404, and move the grinding wheel assembly 300 transversely along with it. The alignment system is configured to reduce or eliminate undesired transverse movement of the grinding wheel assembly 300 during an alignment operation. Additionally, the alignment system prevents undesirable transverse movement resulting from a sharpening operation.

The detent system can also help to prevent undesirable movement and facilitate desirable movement. As the adjustment knob 418 is rotated, the shaft 404 is rotated and the spring pin 436 moves from one detent to the next, requiring a small force to push the spring pin 436 sufficiently out of the first detent and into the next.

Additionally, the configuration of the alignment shaft 404 and bushings 422, 424 prevent undesirable movement during alignment or operation. The compression of the bushings 422, 424 on the shaft 404 increases the force required to rotate the shaft. This has the effect of fixing the position of the shaft such that there is no movement or play in the rotation of the adjustment knob 418. When a user rotates the adjustment knob 418 forward or backward there is substantially no hysteresis or backlash regardless of the y-position of the grinding wheel assembly 300.

The force to move the shaft 404 through the detent positions is easily generated by the rotation of the adjustment knob 418. However, vibration or other mechanical forces occurring during sharpening operation do not have the force to cause the rotation of the shaft between detent position.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include these features, elements and/or states.

Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

While the above detailed description may have shown, described, and pointed out novel features as applied to various embodiments, it may be understood that various omissions, substitutions, and/or changes in the form and details of any particular embodiment may be made without departing from the spirit of the disclosure. As may be recognized, certain embodiments may be embodied within a form that does not provide all of the features and benefits set forth herein, as some features may be used or practiced separately from others.

Additionally, features described in connection with one embodiment can be incorporated into another of the disclosed embodiments, even if not expressly discussed herein, and embodiments having the combination of features still fall within the scope of the disclosure. For example, features described above in connection with one embodiment can be used with a different embodiment described herein and the combination still fall within the scope of the disclosure.

It should be understood that various features and aspects of the disclosed embodiments can be combined with, or substituted for, one another in order to form varying modes of the embodiments of the disclosure. Thus, it is intended that the scope of the disclosure herein should not be limited by the particular embodiments described above. Accordingly, unless otherwise stated, or unless clearly incompatible, each embodiment of this disclosure may comprise, additional to its essential features described herein, one or more features as described herein from each other embodiment disclosed herein.

Features, materials, characteristics, or groups described in conjunction with a particular aspect, embodiment, or example are to be understood to be applicable to any other aspect, embodiment or example described in this section or elsewhere in this specification unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The protection is not restricted to the details of any foregoing embodiments. The protection extends to any novel one, or any novel combination, of the features disclosed in this specification (including any accompanying claims, abstract and drawings), or to any novel one, or any novel combination, of the steps of any method or process so disclosed.

Furthermore, certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations, one or more features from a claimed combination can, in some cases, be excised from the combination, and the combination may be claimed as a subcombination or variation of a subcombination.

Moreover, while operations may be depicted in the drawings or described in the specification in a particular order, such operations need not be performed in the particular order shown or in sequential order, or that all operations be performed, to achieve desirable results. Other operations that are not depicted or described can be incorporated in the example methods and processes. For example, one or more additional operations can be performed before, after, simultaneously, or between any of the described operations. Further, the operations may be rearranged or reordered in other implementations. Those skilled in the art will appreciate that in some embodiments, the actual steps taken in the processes illustrated and/or disclosed may differ from those shown in the figures. Depending on the embodiment, certain of the steps described above may be removed, others may be added.

Furthermore, the features and attributes of the specific embodiments disclosed above may be combined in different ways to form additional embodiments, all of which fall within the scope of the present disclosure. Also, the separation of various system components in the implementations described above should not be understood as requiring such separation in all implementations, and it should be understood that the described components and systems can generally be integrated together in a single product or packaged into multiple products.

For purposes of this disclosure, certain aspects, advantages, and novel features are described herein. Not necessarily all such advantages may be achieved in accordance with any particular embodiment. Thus, for example, those skilled in the art will recognize that the disclosure may be embodied or carried out in a manner that achieves one advantage or a group of advantages as taught herein without necessarily achieving other advantages as may be taught or suggested herein.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately", "about", "generally," and "substantially" may refer to an amount that is within less than 10% of, within less than 5% of, within less than 1% of, within less than 0.1% of, and within less than 0.01% of the stated amount. As another example, in certain embodiments, the terms "generally parallel" and "substantially parallel" refer to a value, amount, or characteristic that departs from exactly parallel by less than or equal to 15 degrees, 10 degrees, 5 degrees, 3 degrees, 1 degree, 0.1 degree, or otherwise.

The scope of the present disclosure is not intended to be limited by the specific disclosures of preferred embodiments in this section or elsewhere in this specification, and may be defined by claims as presented in this section or elsewhere in this specification or as presented in the future. The language of the claims is to be interpreted broadly based on the language employed in the claims and not limited to the examples described in the present specification or during the prosecution of the application, which examples are to be construed as non-exclusive.

Unless the context clearly requires otherwise, throughout the description and the claims, the words "comprise", "comprising", and the like, are to be construed in an inclusive sense as opposed to an exclusive or exhaustive sense, that is to say, in the sense of "including, but not limited to".

Reference to any prior art in this description is not, and should not be taken as, an acknowledgement or any form of suggestion that that prior art forms part of the common general knowledge in the field of endeavor in any country in the world.

The invention may also be said broadly to consist in the parts, elements and features referred to or indicated in the description of the application, individually or collectively, in any or all combinations of two or more of said parts, elements or features.

Where, in the foregoing description, reference has been made to integers or components having known equivalents thereof, those integers are herein incorporated as if individually set forth. In addition, where the term "substantially" or any of its variants have been used as a word of approximation adjacent to a numerical value or range, it is intended to provide sufficient flexibility in the adjacent numerical value or range that encompasses standard manufacturing tolerances and/or rounding to the next significant figure, whichever is greater.

It should be noted that various changes and modifications to the presently preferred embodiments described herein will be apparent to those skilled in the art. Such changes and modifications may be made without departing from the spirit and scope of the invention and without diminishing its attendant advantages. For instance, various components may be repositioned as desired. It is therefore intended that such changes and modifications be included within the scope of the invention. Moreover, not all of the features, aspects and advantages are necessarily required to practice the present invention. Accordingly, the scope of the present invention is intended to be defined only by the claims.

What is claimed is:

1. A skate blade sharpening system, comprising:

a blade retention mechanism configured to securely hold a blade to be sharpened in a sharpening operation within a skate blade opening of the skate blade sharpening system;

a spindle assembly comprising:

a rotating shaft driven by a grinding motor and configured to have a grinding wheel mounted thereon, the grinding wheel contacting the blade during the sharpening operation; and an arbor on the rotating shaft, the arbor having a heat-conducting mating with the grinding wheel when the grinding wheel is mounted on the rotating shaft, and heat dissipation features extending along a portion of the arbor;

a carriage coupled to the spindle assembly, the carriage moving the grinding wheel during the sharpening operation; and an arbor shroud coupled to the spindle assembly, the arbor shroud preventing access to the heat dissipation features through the skate blade opening of the skate blade sharpening system.

2. The skate blade sharpening system of claim 1, wherein the arbor shroud covers at least a portion of a width of the heat dissipation features relative to a rotational axis of the rotating shaft.

3. The skate blade sharpening system of claim 1, wherein the arbor shroud further comprises a sidewall that forms an opening in the arbor shroud, wherein the arbor is disposed at least partially within the opening, the opening extending circumferentially about at least a portion of a circumference of the arbor, wherein the arbor shroud is fixed in a stationary position relative to rotation of the rotating shaft, wherein a gap is formed between the sidewall and the arbor such that the arbor does not contact the sidewall when rotating.

4. The skate blade sharpening system of claim 1, wherein a circumference of the arbor shroud has an opening configured to direct airflow.

5. The skate blade sharpening system of claim 4, wherein the opening is up to one half the circumference of the arbor.

6. The skate blade sharpening system of claim 1, wherein the arbor shroud includes at least one retention feature.

7. The skate blade sharpening system of claim 1, wherein the arbor shroud is coupled to the spindle assembly by at least one fastener.

8. The skate blade sharpening system of claim 1, wherein the arbor shroud includes a plurality of openings in a back wall of the arbor shroud configured to direct airflow.

9. The skate blade sharpening system of claim 1, wherein the arbor shroud includes at least one vertical displacement member on at least one side of the arbor shroud that is configured to vertically displace the grinding wheel relative to the skate blade opening.

10. The skate blade sharpening system of claim 9, wherein the at least one vertical displacement member extends distally from the arbor shroud.

11. The skate blade sharpening system of claim 9, wherein the at least one vertical displacement member is configured to prevent the grinding wheel from contacting jaws of a skate blade retentions system during the sharpening operation.

12. The skate blade sharpening system of claim 1, wherein the heat dissipation features are a set of vanes.

13. The skate blade sharpening system of claim 1, wherein the arbor shroud moves transversely along the blade with the arbor during the sharpening operation.

14. A skate blade sharpening system, comprising:

a blade retention mechanism configured to securely hold a blade to be sharpened in a sharpening operation within a skate blade opening of the skate blade sharpening system;

a spindle assembly comprising:

a rotating shaft driven by a grinding motor and configured to have a grinding wheel mounted thereon, the grinding wheel contacting the blade during the sharpening operation; and an arbor on the rotating shaft, the arbor having a heat-conducting mating with the grinding wheel when the grinding wheel is mounted on the rotating shaft, and heat dissipation features extending along a portion of the arbor; and an arbor shroud coupled to the spindle assembly, the arbor shroud moving transversely along the blade with the arbor during the sharpening operation, the arbor shroud preventing access to the heat dissipation features through the skate blade opening of the skate blade sharpening system.

15. The skate blade sharpening system of claim 14, wherein the arbor shroud includes at least one vertical displacement member on at least one side of the arbor shroud that is configured to vertically displace the grinding wheel relative to the skate blade opening.

16. The skate blade sharpening system of claim 15, wherein the at least one vertical displacement member extends distally from the arbor shroud.

17. The skate blade sharpening system of claim 14, wherein the arbor shroud is coupled to the spindle assembly by at least one fastener.

18. A skate blade sharpening system, comprising:

a blade retention mechanism configured to securely hold a blade to be sharpened in a sharpening operation within a skate blade opening of the skate blade sharpening system;

a rotating shaft driven by a grinding motor and configured to have a grinding wheel mounted thereon, the grinding wheel contacting the blade during the sharpening operation;

an arbor on the rotating shaft, the arbor having a heat-conducting mating with the grinding wheel when the grinding wheel is mounted on the rotating shaft, and heat dissipation features extending along a portion of the arbor; and an arbor shroud preventing access to the heat dissipation features through the skate blade opening of the skate blade sharpening system, a circumference of the arbor shroud having an opening configured to direct airflow.

19. The skate blade sharpening system of claim 18, wherein the opening is up to one half the circumference of the arbor.

20. The skate blade sharpening system of claim 18, wherein the heat dissipation features are a set of vanes.

* * * * *